US005267802A

United States Patent [19]

Parnell et al.

[11] Patent Number: 5,267,802

[45] Date of Patent: Dec. 7, 1993

[54] RIBBON CASSETTE STORAGE AND TRANSFER APPARATUS FOR A PRINTER

[75] Inventors: James A. Parnell, Austin; John C. Venthem, Georgetown; Charles D. Zinsmeyer, Austin, all of Tex.

[73] Assignee: Summagraphics Corporation, Seymour, Calif.

[21] Appl. No.: 920,116

[22] Filed: Jul. 24, 1992

[51] Int. Cl.[5] ..... B41J 35/28

[52] U.S. Cl. ..... 400/208; 400/247

[58] Field of Search ..... 400/196, 208, 208.1, 400/206, 247

[56] References Cited

U.S. PATENT DOCUMENTS

| | | | |
|---|---|---|---|
| 4,288,798 | 9/1981 | Hollmayer . | |
| 4,469,459 | 9/1984 | Treisue et al. | 400/208 |
| 4,569,608 | 2/1986 | Watanabe | 400/208 |
| 4,622,563 | 11/1986 | Watanabe et al. . | |
| 4,647,232 | 3/1987 | Costa . | |
| 4,660,054 | 4/1987 | Kajikawa et al. . | |
| 4,809,018 | 2/1989 | Nakamura et al. | 400/208 |
| 5,180,236 | 1/1993 | Kitahara et al. | 400/208 |

FOREIGN PATENT DOCUMENTS

| | | | |
|---|---|---|---|
| 2912971 | 9/1980 | Fed. Rep. of Germany | 400/208 |
| 58-124687 | 7/1983 | Japan | 400/208 |
| 60-46280 | 3/1985 | Japan | 400/208 |
| 60-72776 | 4/1985 | Japan | 400/208 |
| 61-29578 | 2/1986 | Japan | 400/208 |

*Primary Examiner*—Eugene H. Eickholt

*Attorney, Agent, or Firm*—Rosen, Dainow & Jacobs

[57] ABSTRACT

Apparatus is disclosed for use with printers (or plotters) for storing and transferring ink-containing ribbon cassettes between a print head and a storage location. The printers (or plotters) are of the type which include a print head that is not as wide as the width of the medium to be printed on so that the print head has to be moved to print (or plot) across the full width of the medium. The apparatus automatically removes a cassette mounted to the movable carriage to which the print head is also mounted and deposits it in the storage station, and automatically removes a selected cassette from the storage station and deposits it on the print carriage. The apparatus includes cassette holders at the storage location and a cassette holder mounted to the print carriage. The storage station is positioned in or adjacent the path of travel of the print carriage, and the apparatus holding the cassettes at the storage station may be indexed to position a particular cassette holder into alignment with the cassette holder mounted to the carriage. The cassette holders have cooperating structure which automatically engage each other when the holders are aligned and are moved one into the other to automatically and directly transfer a cassette from one holder to the other.

19 Claims, 15 Drawing Sheets

RIBBON CASSETTE STORAGE AND TRANSFER APPARATUS FOR A PRINTER

RELATED APPLICATIONS

The invention disclosed in this application may be employed in the thermal printer disclosed in U.S. patent application Ser. No. 07/920,186 filed on even date herewith, titled "STRIP MODE PRINTING AND PLOTTING APPARATUS AND METHOD", the disclosure of which is incorporated herein by reference. Application Ser. No. 07/920,186 and this patent application are commonly owned.

BACKGROUND OF THE INVENTION

The invention disclosed herein relates to apparatus for storing and transferring cassettes of strip or ribbon material containing pigment, wax, resin, ink, etc. for use with printers and plotters. More particularly, the invention relates to storing and automatically transferring a selected cassette between a storage location thereof and a use location thereof on a movable print carriage to which a print head is mounted.

Modern color and monochrome computer or digital printing apparatuses are of the matrix type which print an overall image on media in small dots or other small geometric configurations. Matrix printers typically are of the line mode or serial mode type. A line mode printer uses a stationary print head as wide the medium to be printed upon and prints an entire line at a time. A serial mode printer uses a movable so called flying or raster scan print head having a width substantially less than that of the medium to be printed upon which is moved along a line to be printed effectively continuously as the printer prints up to the full width of the medium. As disclosed in application Ser. No. 07/920,186, a matrix printer may also print in a novel strip mode. The print head of a strip mode printer is narrower than the full width of the medium to be printed on, but wider than a typical raster scan print head. The image and/or text to be printed by the strip mode printer is divided into strips each having a width up to the width of the print head. The strip mode print head prints in strips, strip by strip, i.e., part of a line in a strip is printed with the print head held stationary in that strip, then the print head is moved or indexed along the line to another strip of the line which is printed while the print head is held stationary in that strip. Thus, the print head of a strip mode printer is movable and must be moved from strip to strip in order to print on the full width of the medium. Strip mode printing is described in detail in application Ser. No. 07/920,86.

Except for direct thermal printers, typical contact-type printers (line mode and movable print head printers) employ a print head which contacts strip or ribbon material containing a substance such as pigment, wax, resin, ink, etc. which is interposed between the print head and the medium, and transfers the substance from the strip or ribbon material to the medium being imprinted. For simplicity, such substance will hereinafter be referred to as "ink", and such strip or ribbon material, which may be a film, ribbon, etc., will hereinafter be referred to as a "ribbon". Such contact-type printers include impact wire- or pin-dot matrix printers and thermal transfer printers. In order for such contact-type printers to print an image in more than one color, they employ either a ribbon having portions of a plurality of different color inks or a plurality of ribbons of different color inks.

A single multi-colored ribbon has the advantage that ribbon mounting and indexing is relatively simple because only a single ribbon has to be mounted, controlled and guided, and only a single print head is required, as opposed to mounting a plurality of ribbons of different color and either selecting the ribbon with the desired color or providing a different print head for each ribbon. Printers using a single multi-colored ribbon for color printing typically index the entire ribbon past the print head including portions of the ribbon having colors that are not then being printed. Either those unused portions are not used at all, which is wasteful, may require frequent ribbon reloading and may be quite expensive due to high ribbon cost, or the ribbon has to be indexed back to those unused portions for later use, which requires a means to identify unused portions of the ribbon and the color of such unused portions, and a bi-directional indexing means.

Use of a plurality of ribbons avoids the problems discussed above with multi-colored ribbons. However, where a different print head is used for each different colored ribbon, cost may be a problem particularly for thermal printers. Also, where space is a factor, mounting a number of print heads and ribbons in a small space may be difficult. Where a single print head is used, the ribbons must be mounted so that a selected one may be used at a time. In single print head, line mode printers for printing on media of substantial width, the ribbon mounting arrangement would have to provide for satisfactory control and guidance of the selected ribbon for substantially the full width of the media, which would substantially complicate any such mounting arrangement. In single print head, movable print head printers, the ribbon spans a much shorter distance than in line mode printers so that ribbon control and guidance is not as serious a problem as in line mode printers. However, the ribbon mounting arrangement for movable print head printers must provide for ribbon selection relative to a moving print head, rather than the stationary print head of a line mode printer.

Thus, color contact-type printers which employ either a single multi-colored ribbon or a plurality of different colored ribbons have drawbacks.

The following U.S. patents disclose printers which employ a multi-colored ribbon: U.S. Pat. Nos. 4,378,566; 4,542,997; 4,558,329; 4,620,199; 4,707,703; and 4,710,781.

The following U.S. patents disclose printers which employ a plurality of ribbons and a corresponding plurality of print heads, one for each ribbon: U.S. Pat. Nos. 3,926,109 (line mode); 4,067,017 (line mode); 4,403,874 (serial mode); 4,447,818 (line mode); 4,540,992 (line mode); and 4,694,305 (serial mode).

IBM Technical Disclosure Bulletins Vol. 21, No. 11, pp. 4448–4451, April 1979, J. H. Meier et al., and Vol. 22, No. 10, pp. 4481–4482, March 1980, J. H. Meier disclose printers which employ a number of individual stationary print heads arranged to print in line mode fashion and a plurality of ribbons.

U.S. Pat. No. 4,815,869 discloses a printer which employs a single print head and a plurality of ribbons which are used one at a time and are manually loaded into and unloaded from the printer.

The following U.S. patents disclose printers which employ a single print head and a plurality of ribbons: U.S. Pat. Nos. 3,726,212 (line mode); 4,469,459 (serial mode) 4,564,303 (serial mode); 4,647,232 (serial mode); 4,692,774 (serial mode); and 4,809,018 (line mode).

As indicated above, U.S. Pat. Nos. 4,469,459, 4,564,303, 4,647,232 and 4,692,774 disclose serial mode printers which utilize a single print head and a plurality of ribbons. In the '303 patent, two ribbons are mounted within the same cartridge which is moved to position a selected ribbon aligned with the print head. In the "450, '232 and '459 patents, the ribbon cassettes are all mounted on a movable carriage which also carries the print head, which have the disadvantage that the carriage must be relatively large to accommodate a large number of ribbon cassettes, particularly where the ribbons are of a significant width.

U.S. Pat. Nos. 4,135,245; 4,288,798; 4,573,129; 4,660,054; and 4,683,476 disclose pen plotter apparatus which includes a movable plotter head carrying a pen-type instrument and a pen-exchanging apparatus which automatically exchanges a similar pen-type instrument stored off the plotter head with the pen-type instrument currently being carried by the plotter head. As compared to exchange systems for ribbons for color printers, such exchange apparatus is relatively simple given the small size and simple geometric configuration of the pen-type instruments, and given that the pen-type instruments have no moving parts and no ribbon which must be controlled and guided.

The invention seeks to provide an improved apparatus for mounting a plurality of ribbons and automatically positioning a selected ribbon aligned with a movable print head, particularly for use with thermal transfer printers, especially the strip mode printer disclosed in Ser. No. 07/920,186.

SUMMARY OF THE INVENTION

It is an object of the invention disclosed herein to provide an improved ribbon cassette storage and transfer apparatus for a printer.

It is another object of the invention to provide an improved ribbon cassette storage and transfer apparatus for a printer having a movable print head which in printing cooperates with the ribbon in a cassette mounted to move with the print head.

It is another object of the invention to provide such apparatus for a movable print head printer in which unused cassettes need not be carried or moved by the print head.

It is another object of the invention to provide ribbon cassette storage and transfer apparatus for a printer having a movable print head which cooperates in printing with the ribbon in a cassette mounted to move with the print head, in which only a single cassette is mounted to move with the print head and in which a plurality of unused cassettes are stored and not transported with the movable print head.

It is another object of the invention to provide ribbon cassette storage and transfer apparatus for a printer having a movable print head which in printing cooperates with the ribbon in a cassette mounted to move with the print head, and in which movement of the print head effects transfer of a cassette between a position mounted to move with the print head and a position at a storage station not transported with the print head.

Other objects of the invention are to provide such ribbon cassette storage and transfer apparatus which are of relatively simple and rugged construction, and are relatively inexpensive and simple to manufacture.

The invention achieves the above and other objects by releasably or removably mounting a ribbon-carrying cassette to move with a movable print head of a printer along the path of travel thereof such that the ribbon may be moved and acted on by the print head during printing; by providing a storage station that does not move with the print head in which is stored at least one other ribbon cassette; and by automatically removing a cassette mounted to move with the print head and depositing it in the storage station, and by automatically removing a selected cassette from the storage station and depositing it to move with the print head. In the specific embodiments, the print head and a cassette are mounted to a movable carriage, and a least one other cassette is mounted at the storage station off the carriage.

In the preferred embodiments, the invention provides apparatus adapted for use with a printer including a movable carriage, a print head mounted to the carriage and means for cassettes at a storage station and automatically transfers a selected cassette between the storage station and the movable carriage of the printer, i.e., automatically removes a cassette from the carriage and automatically deposits it in the storage location and automatically removes a cassette from the storage location and automatically deposits it on the carriage.

According to specific embodiments, the inventive apparatus comprises cassette first holding means mounted to the carriage for releasably holding a cassette for movement with the carriage along the carriage path of travel, and at least one and preferably a plurality of cassette second holding means mounted at the storage station, one for each of the plurality of cassettes to be held at the storage station. The first holding means positions the cassette relative to the print head such that the ribbon may be unwound from one reel of the cassette, acted upon by the print head and rewound on another reel of the cassette, and so that the cassette may be released by the first holding means and removed from the carriage.

In its preferred form, the inventive apparatus also includes means for automatically causing a cassette carried by either the first holding means or a selected second holding means to be released by the respective holding means and transferred to the other of the respective holding means. In preferred embodiments, such means cause a cassette to be released by the respective holding means and transferred to the other holding means simply by engagement of the respective holding means with each other, and without the need for any specific control operations except for moving the carriage, and/or moving one or more of the cassettes at the storage station and/or aligning the respective holding means between which a transfer is to be made, and without the need for any separate device which would remove a cassette from one holding means and then transfer it to another holding means.

In preferred embodiments, means are provided for positioning any selected cassette second holding means mounted at the storage station in or adjacent the path of travel of the carriage in alignment with the cassette first holding means mounted to the carriage. In a specific embodiment, the entire storage station is positioned in or adjacent the path of travel of the carriage.

In the preferred embodiment, the cassette first holding means and each of the cassette second holding means comprise structure which engage each other when a second holding means is positioned in the path of travel of the carriage aligned with the first holding means and the carriage is moved to the storage station, and which disengage each other when the carriage is moved away from the storage station. The engaging structure of the first holding means and the engaging structure of the second holding means when becoming engaged with each other cause a cassette held by one of those holding means to be automatically and directly transferred to the other of those holding means. The holding means may hold and transfer by flexing, pivoting under resilient loading, by use of latches activated by, for example, a solenoid, etc.

The engaging structure of the first holding means and the engaging structure of the second holding means are preferably identical.

The means for positioning a selected second holding means may comprise means for connecting each of the plurality of second holding means together at the storage station for movement together relative to the path of travel of the carriage and means for moving the connecting means to position a selected second holding means in the path of travel of the carriage in alignment with the first holding means mounted to the carriage. In one embodiment, the connecting means may connect the plurality of second holding means extending in a circle, and the means for moving may rotate the connecting means coaxially with the axis of the circle. In this embodiment, the connecting means may be comprised of a disc- or wheel- or ring-like member having an axis coaxial with the axis of the circle, and that member may be located at an end of the path of travel of the operating station.

In another embodiment, the connecting means may connect each of the plurality of second holding means extending linearly adjacent each other along a longitudinal axis, and the means for moving may move the connecting means relative to the path of travel of the carriage to position a selected second holding means in alignment with the first holding means mounted to the carriage. In one version of this embodiment, the moving means may move the connecting means linearly parallel to the longitudinal axis. In another version, the moving means may pivot the connecting means about the longitudinal axis.

In yet another embodiment, the connecting means may connect each of the plurality of second holding means extending in an endless loop, and the moving means may move the connecting means in the loop. In this embodiment, the connecting means may comprise a belt-like structure, and the belt-like structure may be located at an end of the path of travel of the operating station.

In still other embodiments, the positioning means may position each of the plurality of second holding means in a group of individually movable holding means or cassettes, and the means for moving may move a selected holding means or cassette from the group into alignment with the first holding means mounted to the carriage. In one version of this embodiment, a selected holding means or cassette may be pivoted into alignment with the holding means mounted to the carriage. In another version, a selected holding means or cassette may be translated from its position in the rack directly into its mounting position on the carriage, and in yet another version, the cassette may be transported by a transporting means from the storage station to the carriage.

BRIEF DESCRIPTION OF THE DRAWINGS

The invention disclosed herein is illustrated in the figures of the accompanying drawings which are meant to be exemplary and not limiting, in which like references refer to like or corresponding parts, and in which.

DESCRIPTION OF THE PREFERRED EMBODIMENTS

Figure 1:
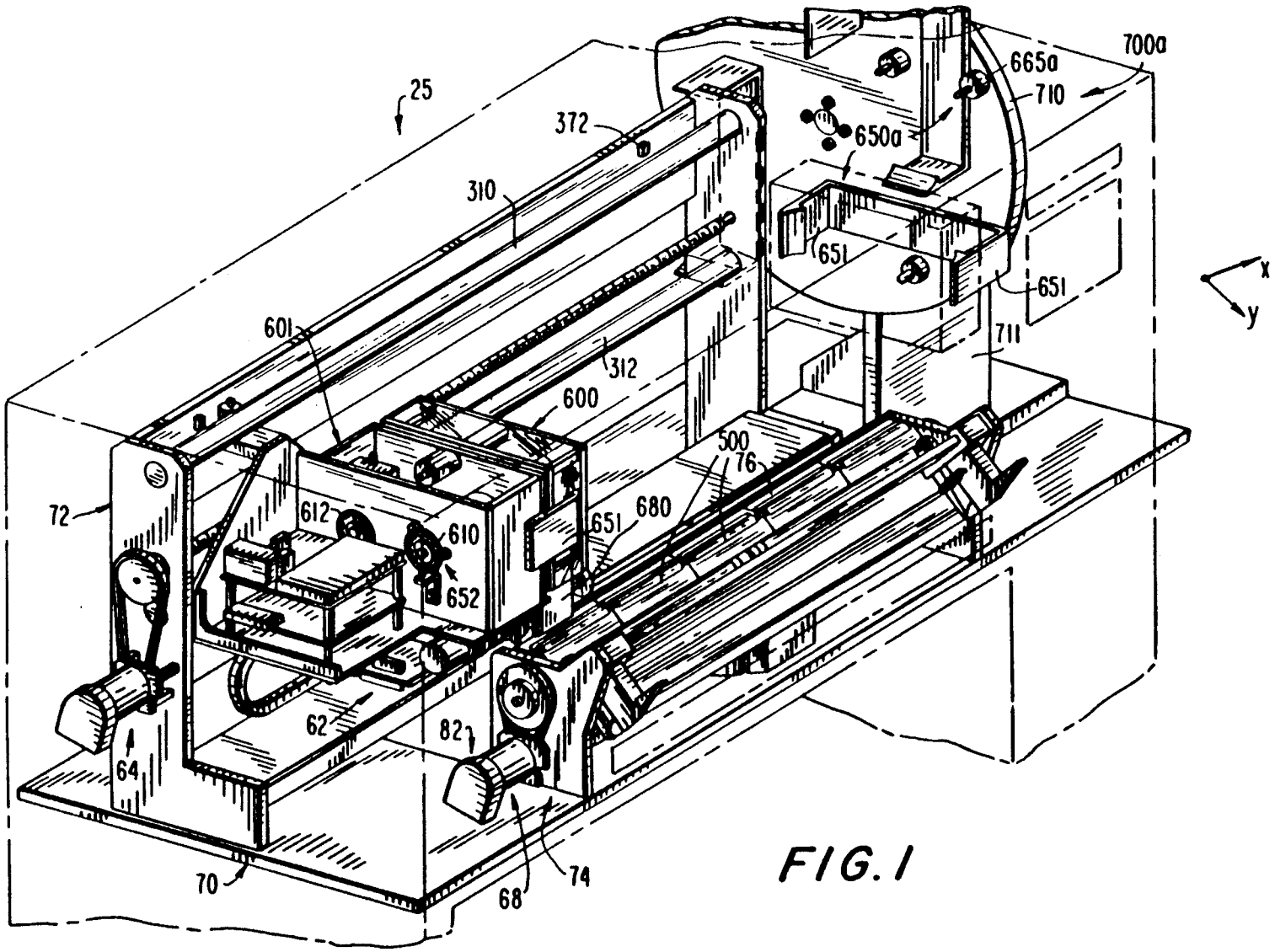
FIG. 1 is a perspective view of a thermal printer employing the ribbon cassette storage and transfer apparatus of the invention disclosed herein.
Figure 3:
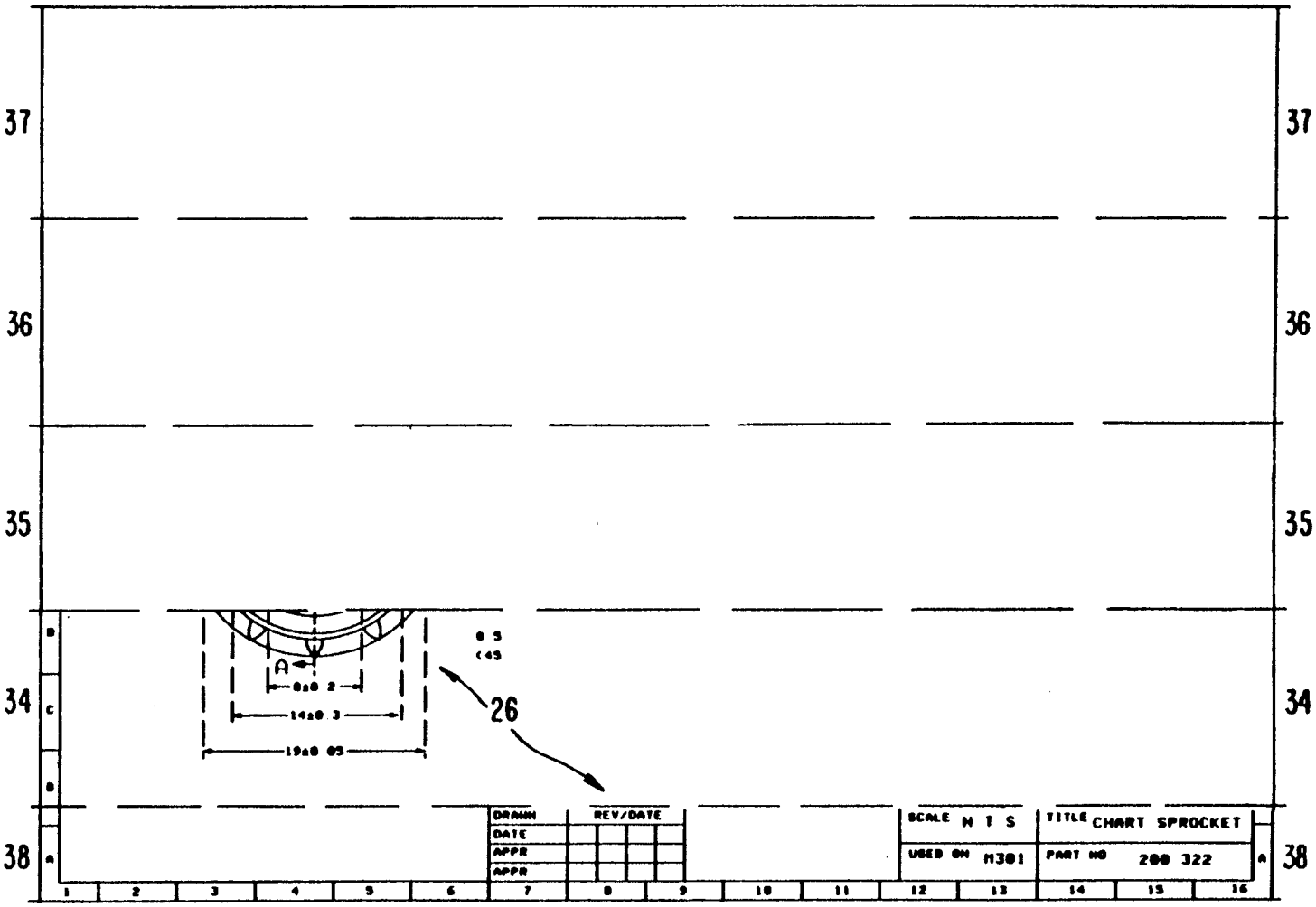
FIG. 3 shows part of the image shown in FIG. 2 with a first strip thereof printed in full and the next strip partially printed.
Figure 4:
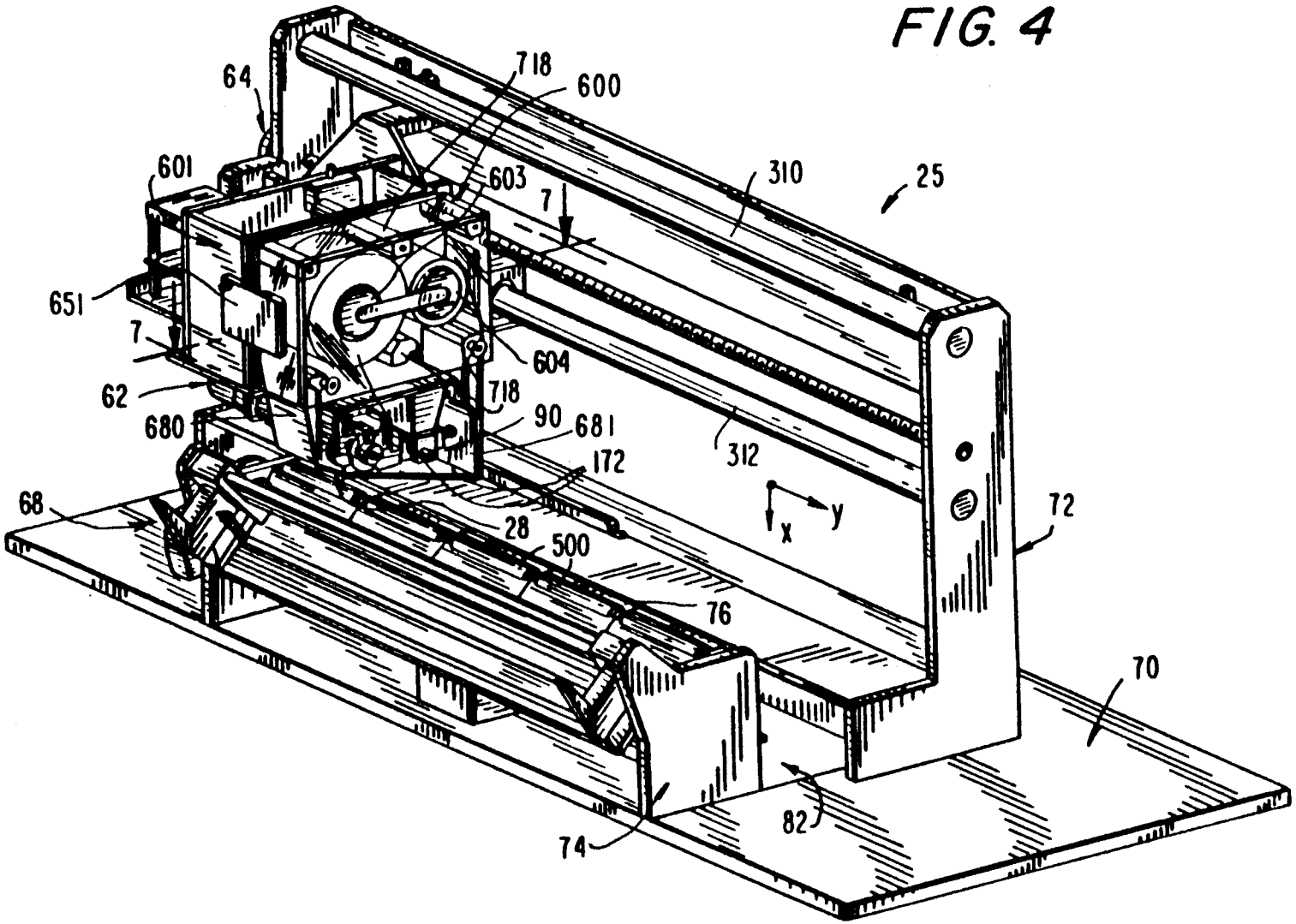
FIG. 4 is a front perspective view from the right side of the thermal printer of FIG. 1 without the cabinet and without the ribbon cassette storage portion of the cassette storage and transfer apparatus.

Thermal printer 25 depicted in FIGS. 1 and 4 prints an image 26 (FIG. 2) on receptor sheet medium 27 (FIGS. 2, 3 and 5) in the strip printing mode described in detail in application Ser. No. 07/920,186 employing a thermal print head 28 (FIGS. 4 and 5) and a thermal donor (transfer) ribbon 172. Sheet medium 27 may be paper, plastic, mylar, etc.; thermal transfer ribbon 172 may be a conventional film having a heat activated pigment, wax, resin, ink, etc. ("ink") layer thereon, and thermal print head 28 may be conventional in so far as the construction and operation of the thermal elements are concerned.

In strip mode printing as described in application Ser. No. 07/920,186, the print head is moved or indexed parallel to the Y-axis to predetermined strip locations relative to the sheet medium to be printed upon, and the sheet medium is moved back and forth parallel to the X-axis relative to the print head. According to convention, the Y-axis is parallel to the line direction or scan direction of printers and plotters, and the X-axis is parallel to the sheet medium feed direction which is perpendicular to the Y-axis. The disposition of the X-axis and Y-axis is in accordance with the convention usually used with printers and plotters and is referenced in FIGS. 1, 4 and 5.

Figure 2:
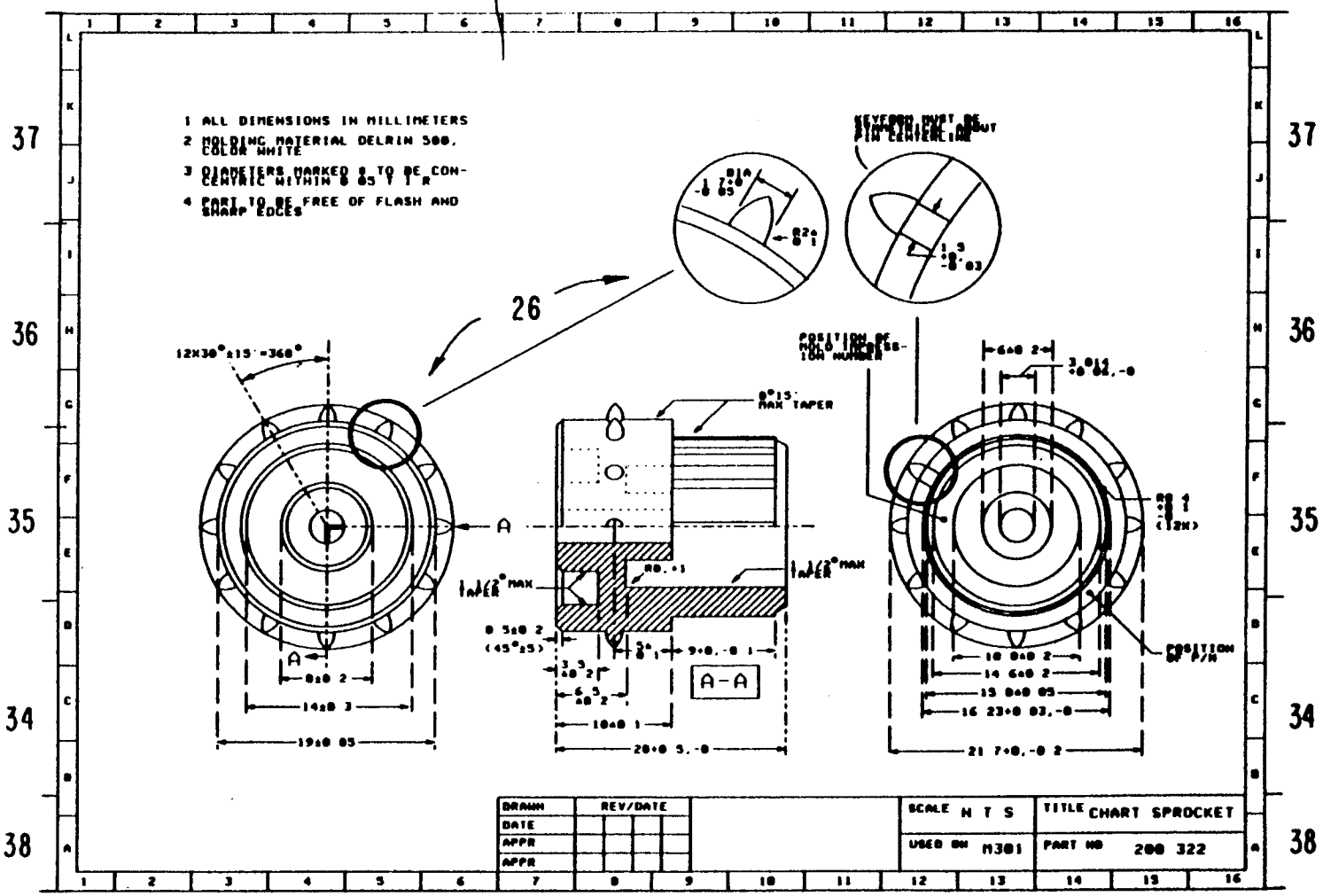
FIG. 2 shows in full an image printed by the thermal printer of FIG. 1.

Referring to the image shown in FIGS. 2 and 3, print head 28 (not shown in FIGS. 2 and 3) is moved parallel to the Y-axis to position the print head to print in a strip 34–38; then while print head 28 is stationary, sheet medium 27 is moved parallel to the X-axis as print head 28 prints in lines (not shown) each having a width equal to the width of a thermal element array (not shown) in the print head.

Strips 34–37 each have a width equal to the width of the thermal element array of print head 28. Depending upon the particular width of sheet medium 27 and the particular length of the thermal element array, thermal printer 25 may print in one or more partial length strips 38 at either or both edges of sheet medium 27 in order to print on the full width of the sheet medium. In the sequence of printing the image 26 illustrated by FIGS. 2 and 3, only one partial width strip 38 is required, which is shown fully printed in FIG. 3, and four full width strips are required, only one strip 34 of which is shown partially printed in FIG. 3.

Figure 5:
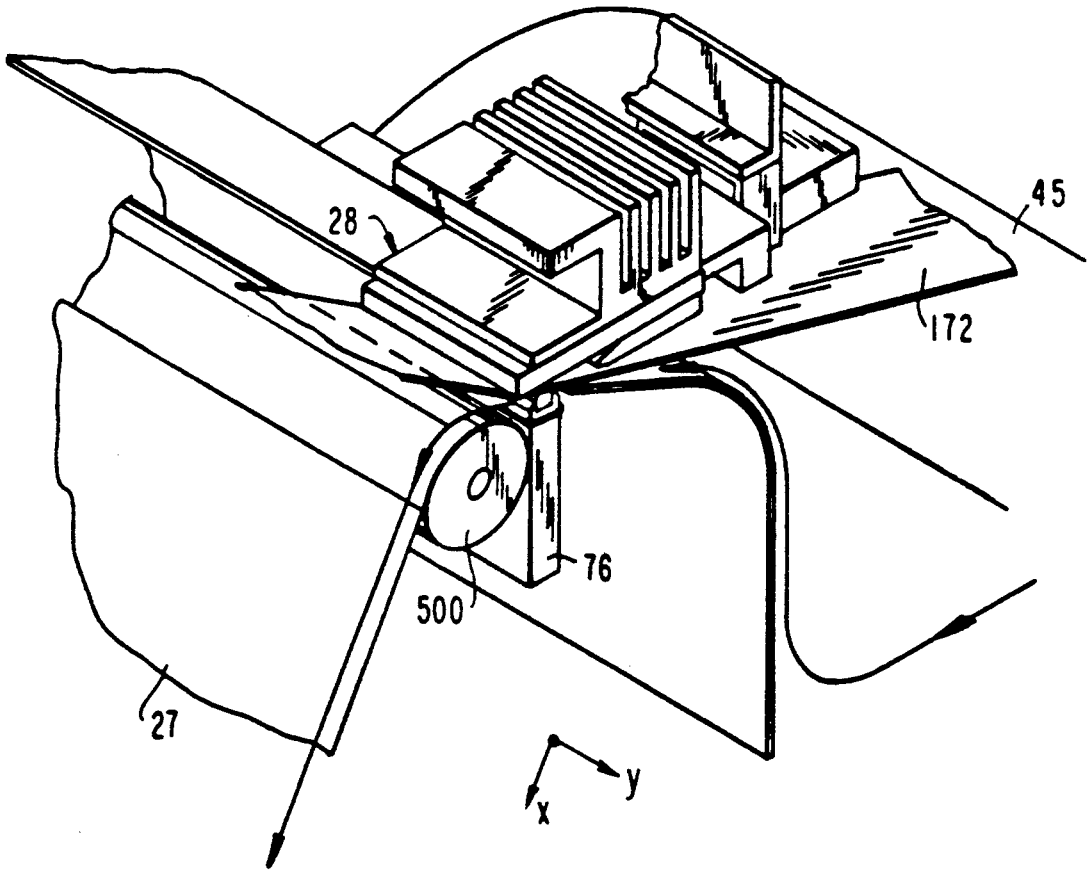
FIG. 5 is an enlarged perspective view from the right side of the thermal printer of FIG. 1 showing the thermal print head, a portion of the print head support, a portion of the platen, a portion of the sheet medium roll with a sheet portion therefrom passing between the print head and the platen, a portion of the ribbon passing between the sheet medium and the print head, and a portion of the X-axis guide roller.

Referring to FIG. 5, during printing, thermal elements in the print head contact the thermal transfer ribbon and press the ribbon 172 against the sheet medium 27 which is supported by a platen 76. By heat and some pressure for a predetermined minimum "dwell" time, print head 28 activates and transfers the carried by ribbon 172 onto sheet medium 27 while sheet medium 27 is continuously moved past print head 28. Further details of the thermal strip mode printing process may be found in application Ser. No. 07/920,186.

Referring to FIGS. 1 and 4, thermal printer 25 comprises a base 70 to which are mounted in fixed relation to each other a Y-axis frame 72 and an X-axis frame 74. Y-axis frame 72 supports print carriage 62 and a Y-axis drive system 64, and X-axis frame 74 supports platen 76 and an X-axis drive system 68. Sheet medium 27 (FIGS. 5 and 6) is fed from a roll 45 mounted to frame 70 through a slot 82 (FIGS. 1 and 4) therein past print head 28 and platen 76 to X-axis drive system 68.

The X-axis drive system 68 (FIGS. 1 and 4) moves sheet medium 27 parallel to the X-axis back and forth past print head 28 and platen 76 over guide rollers 500 (see also FIG. 5). X-axis drive system 68 is of the pinch roller type in which the sheet medium is pinched between rigid drive rollers (not shown) and resilient pinch or idler rollers (not shown). Referring to FIG. 4, print head 28 is supported from carriage 62 by a print head support 90, and print carriage 62 is supported from Y-axis frame 72 via rods 310 and 312 for movement back and forth parallel to the Y-axis. Application Ser. No. 07/920,186 describes and illustrates further details of thermal printer 25.

Figure 7:
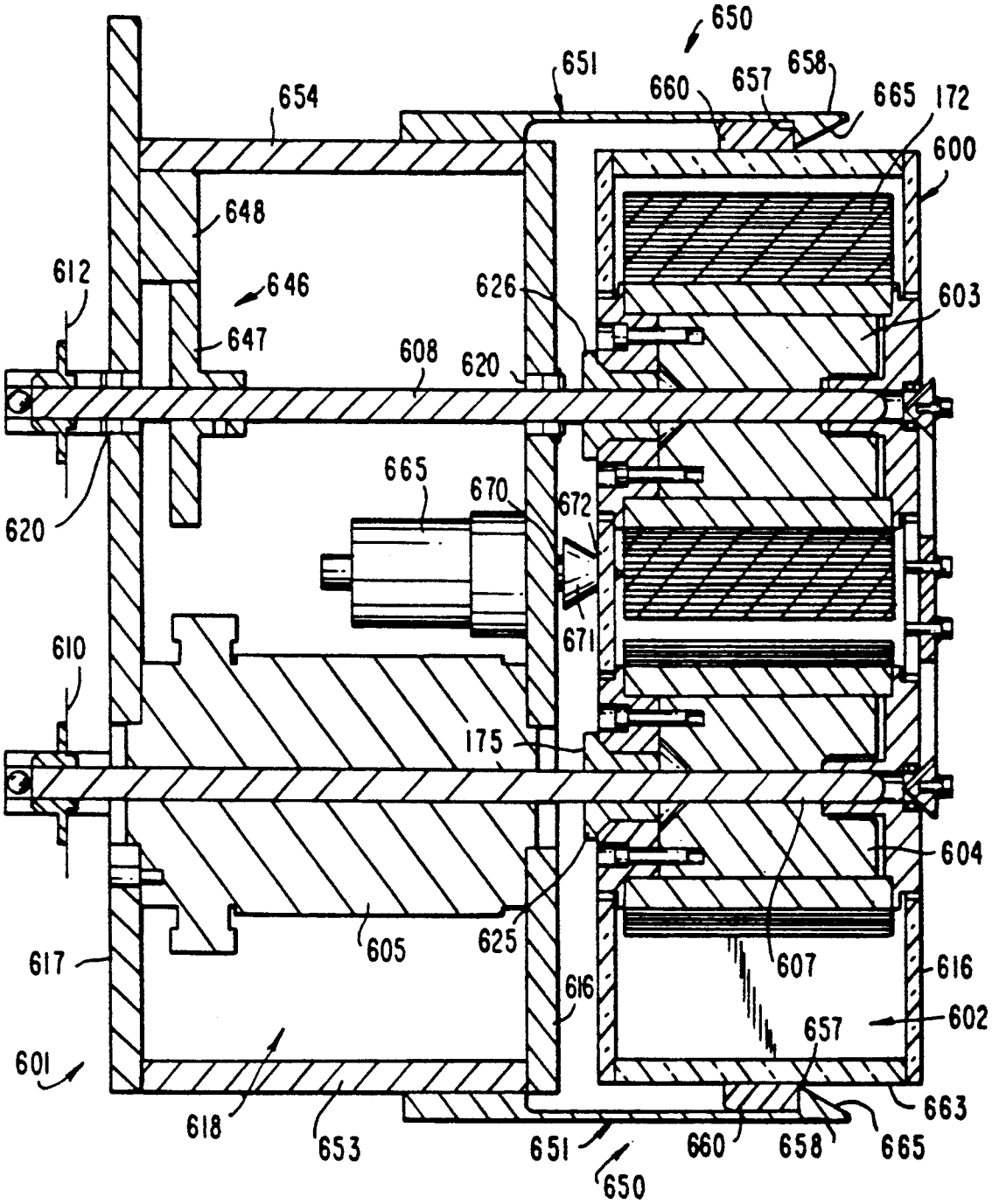
FIG. 7 is a cross section view of a ribbon cassette mounted to its drive system on the print carriage of the printer of FIG. 1 taken along line 7—7 of FIG. 4.

Referring to FIG. 4, carriage 62 supports a mounting and drive system 601 for a cassette 600 of thermal transfer ribbon 172. Referring to FIG. 7, cassette 600 includes a housing 602 within which are rotatably mounted a transfer ribbon supply reel 603 and a transfer ribbon take-up reel 604. Ribbon drive system 601 comprises a take-up reel drive motor 605 having a shaft 607 (functioning as a take-up spindle) projecting from and rotated by motor 605, a supply spindle 608, and shaft encoder discs 610 and 612 attached to take-up spindle 607 and supply spindle 608, respectively. Shaft encoder disks 610 and 612 form part of sensors 652 (described below), only one of which is shown in FIG. 1. Drive motor 605 and spindle 608 are supported by opposed walls 616, 617 of a ribbon drive housing 618 which is mounted on carriage 62. Take-up spindle 607 projects from wall 616 a substantial distance sufficient to enter cassette housing 602 and be received in take-up reel 604, and also projects from opposite wall 617 a short distance sufficient to rotate the shaft encoder disc 610 mounted on the outside of the wall 617. Similarly, supply spindle 608 projects from opposite wall 616 a substantial distance sufficient to enter cassette housing 602 and be received in supply reel 603, and also projects from wall 617 a short distance sufficient to enable rotation of the shaft encoder disc 612 mounted outside of the wall 617.

The reels 603, 604 are mounted for rotation in cassette housing 602. A drive sprocket 625 is affixed to projecting take-up spindle 607 adjacent wall 616 to engage take-up reel 604 and thereby enable the motor 605 to rotate the take-up reel. A drive sprocket 626 is fixed to projecting supply spindle 608 adjacent wall 616 to engage supply reel 603 so that supply spindle 608 rotates with supply reel 603. Ribbon take-up reel 604 has a central recess at the end thereof toward the housing 618 for receiving the drive sprocket 625, and ribbon supply reel 603 has a central recess at the end thereof toward the housing 618 for receiving and engaging the sprocket 626. Rotation of take-up spindle 607 by motor 605 causes take-up reel 604 to rotate and wind ribbon thereon from supply reel 603 which rotates relatively freely under the braking action of a brake. The brake may be comprised, for example, of a brake rotor 647 affixed to the shaft 608 and adapted to be engaged by a suitable brake pad 648 mounted to the housing 618.

Shaft encoder discs 610 and 612 (FIG. 7) form part of sensors 652 (only one of which is shown in FIG. 1), and are mounted for rotation with take-up spindle 607 and supply spindle 608, respectively. Sensors 652 are preferably of the optical type. Each disk 610, 612 comprises an opaque disc having holes therein or markings thereon, and sensors 652 may be conventional optical sensors which include a light emitting diode (not shown) and photo detector (not shown) mounted to opposed arms between which the respective disc 610, 612 is rotated. Sensors 652 provide data to a printer controller (not shown herein, but shown and described in application Ser. No. 07/920,186 which determines the diameter of ribbon wound on supply reel 603 and take-up reel 604. This information is used by the printer controller to adjust the tension on ribbon 172. Additionally, the shaft encoder information may be used by the printer controller to track actual transfer ribbon use and for transfer ribbon replenishment. Details of the determination of ribbon diameters on the reels and determination of transfer ribbon tension and usage are described in U.S. patent application Ser. No. 07/920,116, titled Method And Apparatus For Gauging Reel Diameters In A Reel-To-Reel Material Transport System, the disclosure of which is incorporated herein by reference.

Referring to FIG. 7, cassette 600 is removably or releasably mounted to ribbon drive housing 618 as follows. A cassette holder referenced generally by 650 comprises flexible, cassette retention snaps 651 (FIG. 7) which are affixed to and extend from the front 653 and rear 654 of drive housing 618 beyond wall 616 and two locating assemblies 605 (only one of which is shown). Retention snaps 651 thus are spring-loaded and act as leaf springs. The end of each retention snap 651 is structured so as to engage a lug 660 on the exterior front 663 and rear 664 of cassette housing 602 and thereby retain a cassette. Also the end of each retention snap 651 is structured to permit a retention snap of an unoccupied cassette holder to cam a retention snap of an occupied holder out of engagement with the lug on the retained cassette that the later holds, and into engagement with the retention snap of the unoccupied holder, thereby effecting an automatic and direct transfer of a cassette from one holder to the other simply by moving aligned cassette holders into and out of engagement with each other.

With continued reference to FIG. 7, the end of each retention snap 651 resembles in cross section the tip of a fish hook, and is structured as follows. On one side of the end of each retention snap 651 extends a sloping camming surface 655 which begins with a right angle detent surface 657. The other side 658 of the end of retention snap 61 opposite camming surface 655 is straight. Snap lugs 660 positioned on the exterior front 663 and rear 664 of cassette housing 602 contact and engage respective right angle detent surfaces 657 of respective retention snaps 651 to mount cassette 600 to housing 618. Two spaced locating and preloading assemblies 665 (only one of which is shown) are mounted to drive housing 618 to properly locate and seat cassette 600 relative to housing 618. Each locating and preloading assembly 665 comprises a spring-loaded plunger 670 with a conical locating and preloading head 671 projecting therefrom. Cassette housing 602 includes corresponding locating holes 672 positioned to be engaged by respective the conical heads 671 of the plungers 670. Locating and preloading assemblies 665 assist in properly seating cassette 600 against drive housing 618 with transfer ribbon 172 in its proper position relative to print head 28, and also assist in transferring a cassette 600 to and from housing 618, as described below.

Figure 10:
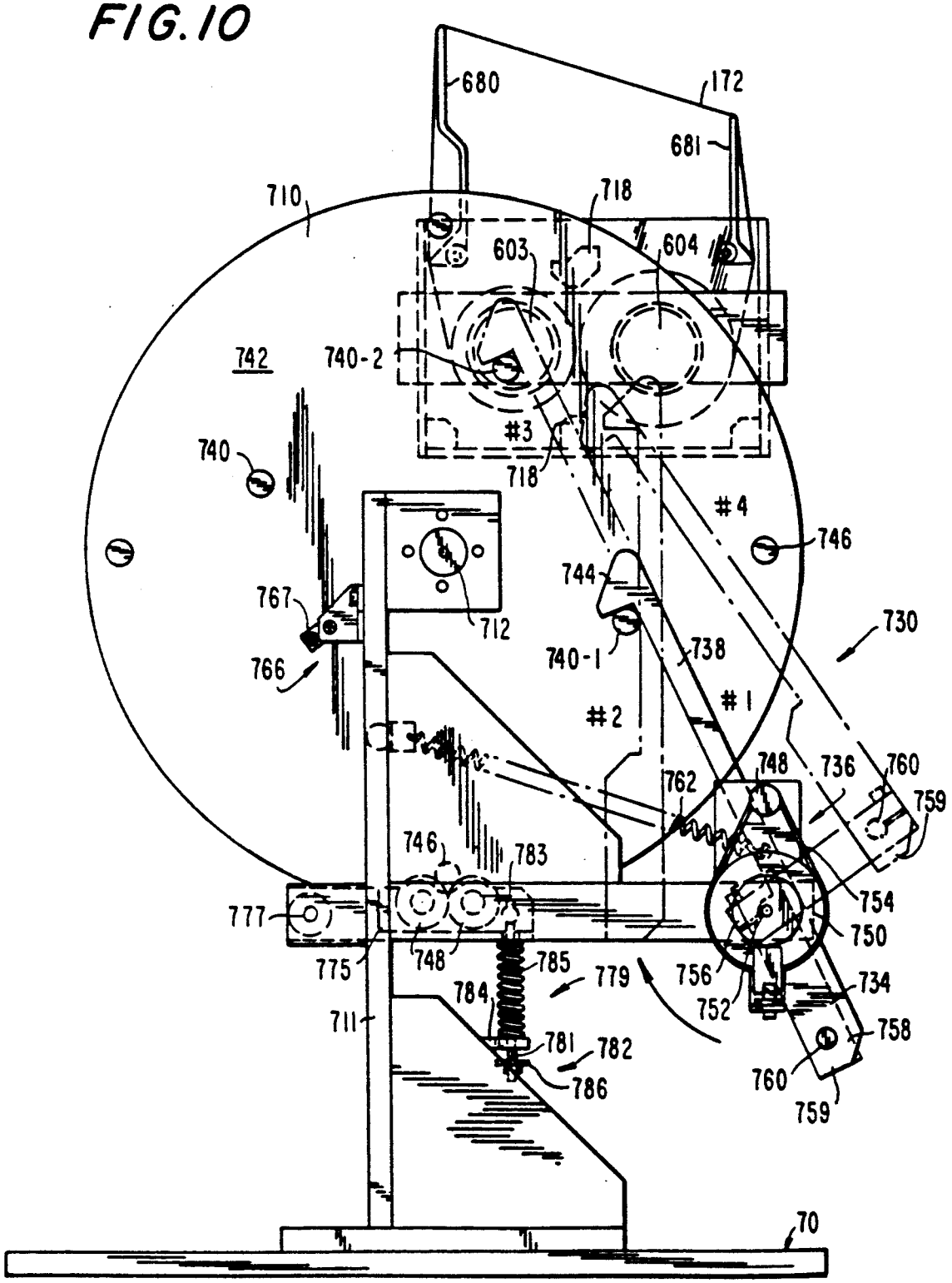
FIG. 10 is an elevation view of the indexing side (left side relative to the thermal printer of FIG. 1) of the turret of FIG. 8.

Referring to FIGS. 4 and 10, cassette 600 includes a ribbon guide 680 pivotally connected to cassette housing 602 adjacent supply reel 603 and a ribbon guide 681 pivotally connected to cassette housing 602 adjacent take-up reel 604. Ribbon guides 680, 681 are spring loaded to the positions shown in FIGS. 7 and 10, i.e., to extend parallel to the walls of cassette housing 602, and may be pivoted towards each other against the action of the spring loading when stored in order to reduce storage space requirements. Alternatively, guides 680 and 681 may be fixed to cassette housing 602 extending therefrom parallel to the walls thereof, or may be formed as part of the cassette itself.

Figure 6:
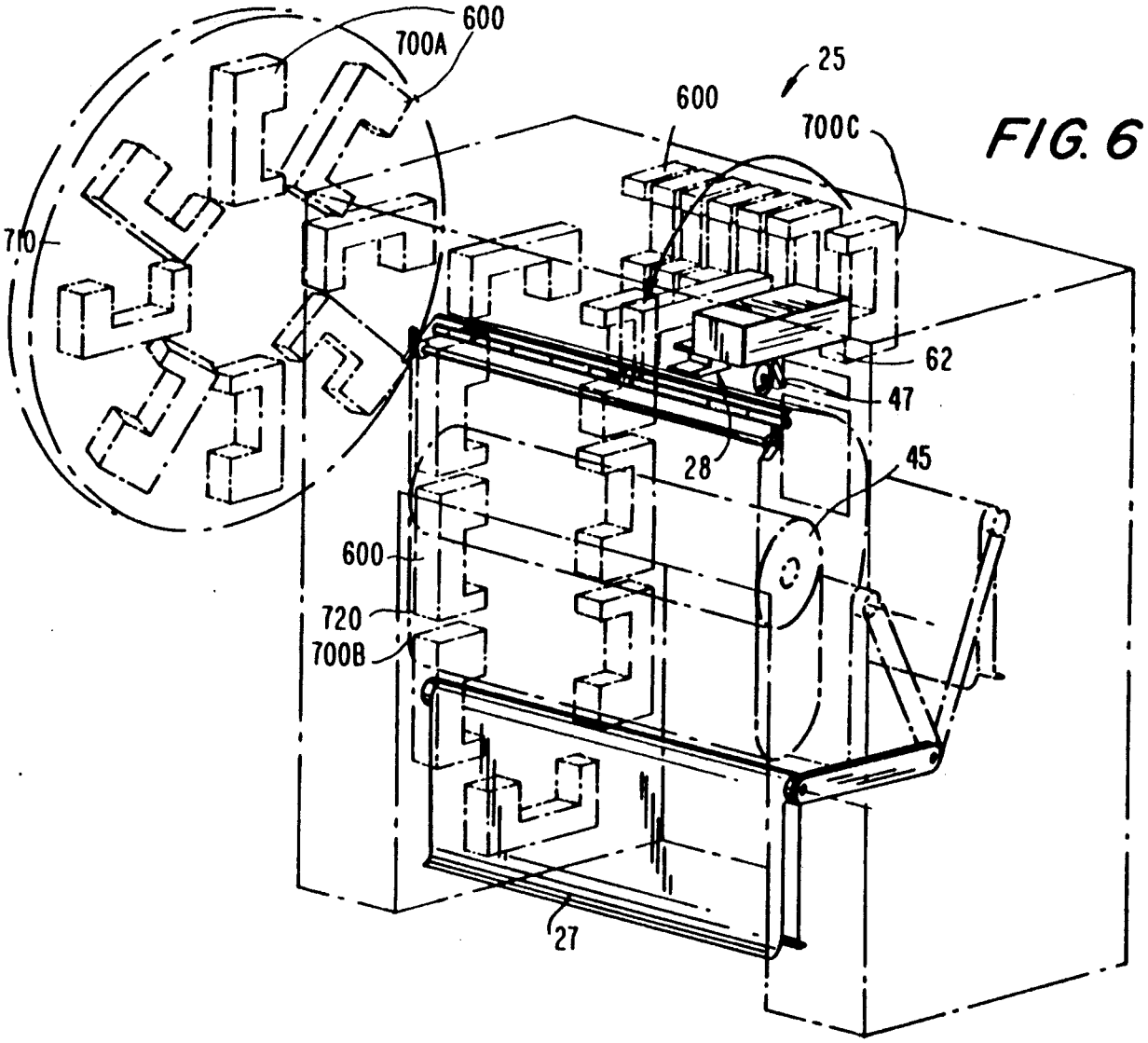
FIG. 6 is a schematic diagram of the thermal printer of FIG. 1 showing three embodiments of apparatus for storing ribbon cassettes and for transferring a respective cassette between its storage position and its printing position, and also showing a media cutter, a media hanger and a roll of sheet medium.

As indicated above, printer 25 may print in monochrome or color. For color printing, a number of transfer ribbons of desired final colors are provided or an n color system is provided, e.g., a four color system comprising yellow, magenta, cyan and black, or both. In accordance with the invention, cassette transfer for color printing, or simply for loading a fresh cassette on carriage 62, is automated. Referring to FIGS. 1 and 6, a number of cassettes 600 may be stored in a cassette storage and transfer apparatus 700*a*, 700*b* or 700*c*. An access door (not shown) is provided in the cabinet of printer 25 to permit easy changing of ribbon cassettes 600.

Cassette storage and transfer apparatus 700*a* may comprise a disk or wheel-like turret 710 to which are releasably mounted a plurality of cassettes 600. Turret 710 is located in the Y-axis path of travel of print carriage 62 at the end thereof (either the right or left end, as described below). Turret 710 is indexed by the printer system controller to position a desired cassette releasably held at a given turret location into a cassette transfer position aligned with the cassette holder mounted on carriage 62. Alternatively, a cassette storage and transfer apparatus 700*b* (FIG. 6) may comprise a number of cassettes 600 mounted to cassette holders on an endless belt 720 located at the end of the Y-axis travel of print carriage 62 which is indexed by the printer controller to position a desired cassette releasably held by belt 720 in the cassette transfer position. Or a cassette storage and transfer apparatus 700*c* may comprise a rack (not shown) carrying a number of cassettes 600. The rack may be provided with a number of cassette holders which are individually pivotally mounted to Y-axis frame 72 to pivot about an axis parallel to the Y-axis towards ribbon drive system 601, or individually translationally mounted, or the entire rack may pivot or translate. In the pivoting embodiment, print carriage 62 is positioned by the printer controller adjacent the desired cassette holder in the rack, and that cassette holder or the entire rack is pivoted under control of the printer controller to effect a cassette transfer. In the translational embodiment, the entire rack may be moved to a cassette loading position, and the individual cassette to be loaded may be translated from the rack onto the print carriage, or separate means may remove a cassette from a stationary rack and deposit it on the print carriage. Other cassette storage and transfer apparatus will be evident to those skilled in the art from the state of the art and the disclosure herein. Automated loading and unloading of a cassette 600 from carriage 62 is described below in connection with cassette transfer apparatus 700*a*.

Figure 8:
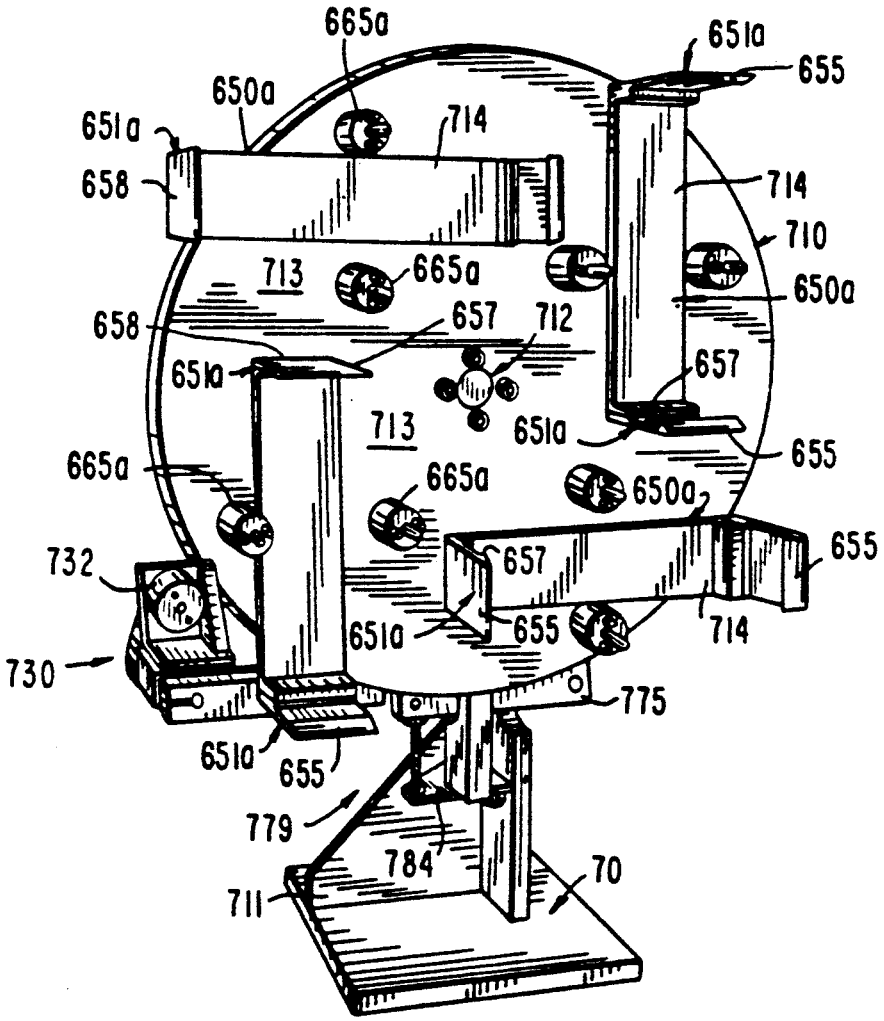
FIG. 8 is an elevation view of the cassette side (right side relative to the thermal printer of FIG. 1) of the turret of the storage portion of the ribbon cassette storage and transfer apparatus according to one embodiment of the invention.

Turret 710 for cassette storage and transfer apparatus 700*a* as shown in FIGS. 1, 8 and 10–11 is in the form of a solid disc. However, other configurations are suitable as long as the turret may carry a plurality of cassettes and be indexed. For example, turret 710 make be provided in the shape of a ring or star wheel, as described below in connection with FIGS. 12–14. In the embodiment of FIG. 8, turret 710 has four cassette locations, each being defined by a cassette holder 650*a*, which permits mounting four cassettes, for example to be used in a four color system.

Figure 11:
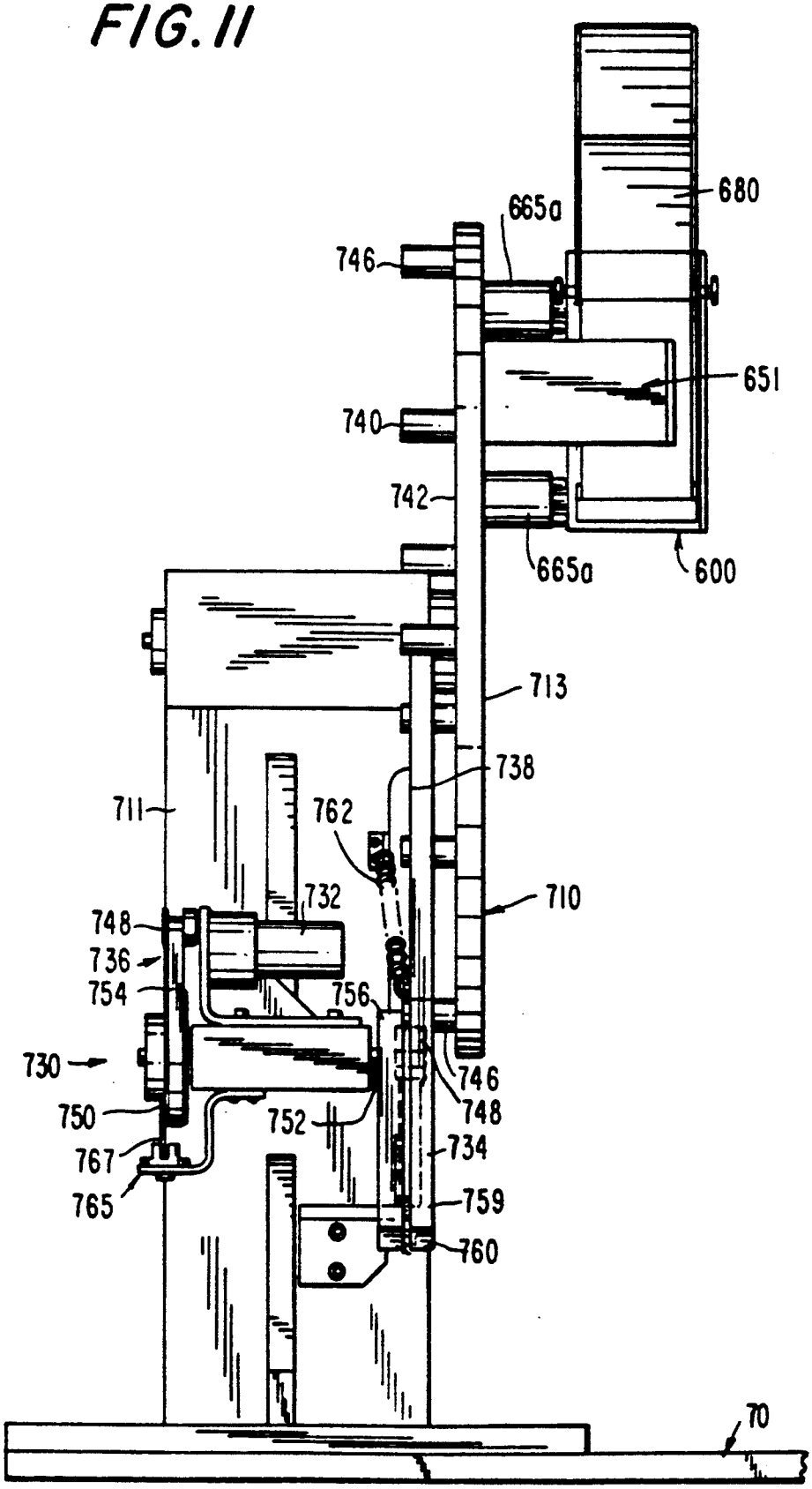
FIG. 11 is an elevation view of the front end (relative to the thermal printer of FIG. 1) of the turret of FIG. 8.

As shown in FIGS. 8 and 10–11, turret 710 is rotatably mounted to a turret frame 711 by a bearing 712, and turret frame 711 is in turn mounted to base 70 (FIG. 1) at the right end of printer 25. Each cassette 600 is removably mounted to turret 710 by a cassette holder 650*a* which is similar to cassette holder 650 shown in FIG. 7. Each cassette holder 650*a* includes a base plate 714 which is not required by holder 650. Also, two spring-loaded guide pin assemblies 665*a* assist in locating, seating and transferring a cassette instead of the locating and preloading assemblies 665 attached to the cassette drive housing 618. Referring to FIG. 8, each cassette holder 650*a* comprises a pair of flexible cassette retention snaps 651*a* extending from side 713 of turret 710. The retention snaps 651*a* are essentially fastened to opposed ends of a base plate 714 which is fastened to side 713 of turret 710. Alternatively, the retention snaps 651*a* and base plate 714 may be made one-piece. Retention snaps 651*a* are the same as described above for ribbon drive housing 618, and the cassettes 600 are retained by engagement of respective snap lugs 660 on a respective cassette by respective retention snaps 651*a* on turret 710 in the same manner as described above with respect to ribbon drive housing 618.

A pair of guide pin assemblies 665*a* is provided for each cassette holder 650*a* extending from turret 710 on opposite sides of base plate 714 about mid-way between respective pairs of retention snaps 651*a*. Each guide pin assembly 665*a* comprises three pins, the outer two of which are spring-loaded. Referring to FIG. 4, each cassette 600 includes a pair of single hole receptacle posts 718 which mate with and receive the center pin of a guide pin assembly 665*a*. The two outer spring loaded pins bear against the face of the cassette and spring load it to the respective cassette holder.

Figure 9A:
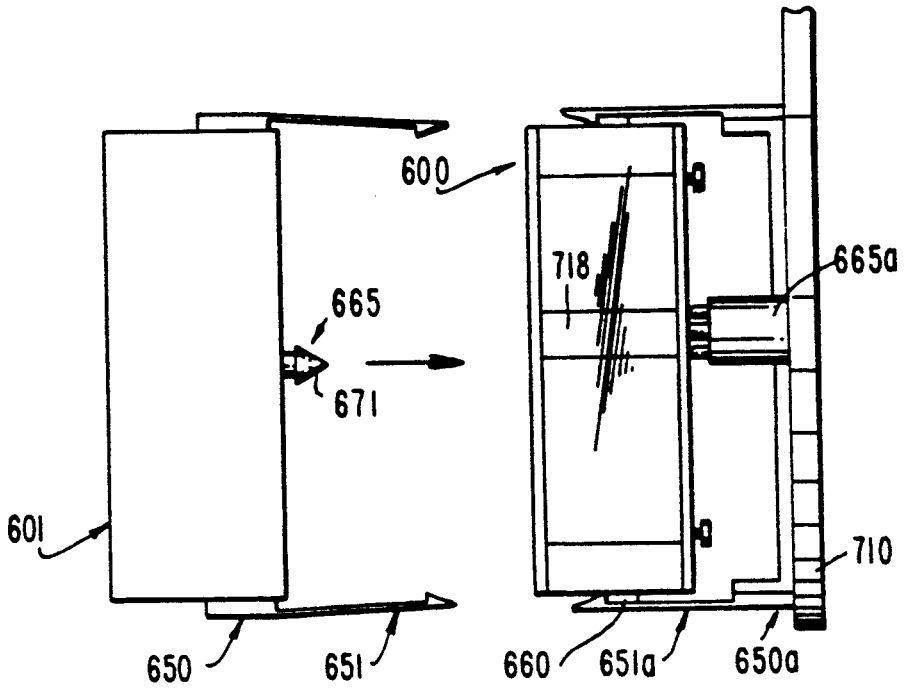
FIG. 9A is a side view of portions of the print carriage and the turret showing the relative positions thereof at the start of a cassette transfer operation from the turret to the print carriage.

A cassette 600 is automatically transferred from between a pair of retention snaps 651*a* on turret 710 into the pair of retention snaps 651 on ribbon drive housing 618 on carriage 62 as follows. As shown in FIG. 1, turret 710 is mounted to base 70 at the right side end of the Y-axis travel of carriage 62 such that retention snaps 651 on ribbon drive housing 618 and retention snaps 651*a* on turret 710 face each other. Pairs of retention snaps 651*a* on turret 710 extend in a circle such that whenever turret 710 is indexed, a different pair of retention snaps 651*a* on turret 710 will be exactly aligned with the pair of retention snaps 651*a* extending from ribbon drive housing 618 on carriage 62 as shown in FIG. 9A. Turret 710 is indexed (as described below) to position a desired cassette 600 in the cassette transfer position.

Figure 9B:
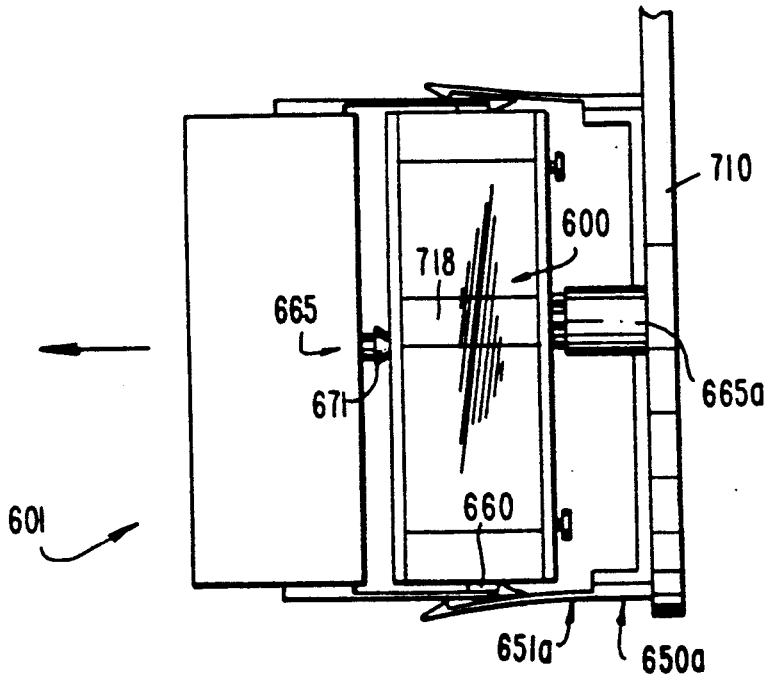
FIG. 9B is a side view similar to that of FIG. 11A showing the relative positions of the cassette mounting elements on the print carriage and the turret during the transfer operation.

A cassette transfer from turret 710 to carriage 62 is effected as follows. With reference to FIGS. 9A and 9B, after turret 710 has been indexed to the desired position, carriage 62 is moved parallel to the Y-axis towards turret 710 causing the ends of the retention snaps 651 of the cassette holder 650 on carriage 62 to contact the ends of the retention snaps 651 of cassette holder 650*a* on the turret 710 (not shown). As carriage 62 continues advancing towards turret 710, the straight side 658 of the retention snaps 651 of the unoccupied holder 650 on carriage 62 contact the camming surface 655 of retention snaps 651 of the occupied holder 650*a* on turret 710 and flex the retention snaps 651 of holder 650*a* away from the sides of cassette 600 and out of engagement with the snap lugs 660 on the cassette. At the same time, the camming surface 655 of the retention snaps 651 of the holder 650 on carriage 62 contact the snap lugs 660 on the cassette and are cammed over the lugs with continued movement of the carriage until the snaps 651 of the holder 650 on the carriage engage the cassette lugs as shown in FIG. 11B.

Sensor 372 (FIG. 1) is positioned to indicate the right end position for carriage 62 to achieve a cassette exchange. Sensor 372 transmits a home signal to the printer controller when carriage 62 reaches the right end home position, at which time movement of carriage 62 is reversed. Thereafter, print carriage 62 is moved in the opposite direction away from turret 710, with the cassette holder 650 on the carriage engaging the cassette, and the camming surface 655 of the retention snaps 651*a* of the holder 650*a* on the turret simply sliding on the straight part 658 of the retention snaps 651 on the carriage until the respective snaps 651, 651*a* no longer contact each other.

Guide pin assemblies 665*a* assist in seating a cassette 600 and in transferring a cassette 600 during a cassette transfer as follows. While at rest, guide pin assemblies 665*a* act to force the cassette snap lugs 660 against the right angle detent surfaces 657 of the ends of the respective retention snaps 651*a*. This ensures accurate, repeatable axial location of the cassette. During a cassette transfer, the outer spring-loaded pins of the guide pin assemblies 665*a* act to counter the force imparted by the retention snaps 651 of the approaching cassette holder 650 mounted to print carriage 62. By providing a force for the approaching retention snaps 651 on print carriage 62 to act against, the approaching retention snaps 651 can perform their camming motions against the stationary retention snaps 651*a* on the turret and on the cassette snap lugs 660 on the cassette mounted to the turret. The resilient mounting of cassette 600 also guards against jamming, bending, and breakage while always ensuring that the cassette is returned to a known position, i.e., the snap lugs 660 on the cassette against the right angle detent surface 657 of the cassette holder retention snaps 651*a*.

Transfer of a cassette 600 on carriage 62 to turret 710 proceeds in essentially the same way, but with the unoccupied and unengaged retention snaps 651*a* of holder 650*a* on turret 710 and the occupied and engaged retention snaps 651 of holder 650 on ribbon drive housing 618 being reversed from the positions shown in FIGS. 9A and 9B.

Referring to FIGS. 10–11, indexing system 730 for indexing turret 710 comprises motor 732 mounted to turret frame 711, crank 734, reduction drive system 736 which couples motor 732 to crank 734, indexing arm 738 which is connected to crank 734, indexing posts 740 which extend from side 742 of turret 710 and which are engaged by hook 744 of indexing arm 738, detent posts 746 which extend from side 742 of turret 710, and a pair of detent rollers 748 rotatably mounted to detent frame 775 and spaced to receive therebetween and releasably engage a respective detent post 746 when turret 710 is in a fully indexed position, i.e., a cassette exchange position. Reduction drive system 736 comprises a timing pulley 748 fixed to the shaft of motor 732, a timing pulley 750 fixed to shaft 752 which is rotatably mounted by bearings (not shown) to turret frame 711 and a timing belt 754 positively connecting pulleys 748 and 750. Crank 734 is connected at one end 756 to shaft 752 to rotate therewith so that the opposite end 759 of crank 734 defines a circle as shaft 752 rotates. End 759 of crank 734 is connected to end 758 of indexing arm 738 by a bearing 760 so that end 758 of indexing arm 738 also rotates in a circle but at the same time is free to itself rotate about the axis of bearing 760. A spring 762 is connected to indexing arm 738 between end 758 and hook 744 thereof and to turret frame 711. Spring 762 biases indexing arm 738 towards the central axis of turret 710 so that hook 744 may engage the respective indexing posts 740.

A cassette exchange position sensor 765 (FIG. 11) and a home position sensor 766 (FIG. 10) are provided so that the printer controller may set and determine the absolute position of turret 710 at power-up and during operation. Sensors 765 and 766 are of the conventional optical type which includes a light emitting diode (not shown) and a photo detector (not shown) mounted to opposed arms. Indexing sensor 765 is mounted to turret frame 711 adjacent the periphery of pulley 750, and an opaque tab 767 is mounted to pulley 750 to rotate therewith and pass between the arms of sensor 765 as pulley 750 rotates. Sensor 765 emits a signal to the printer controller each time that tab 767 passes between the arms of sensor 765 to indicate one complete revolution of pulley 750 corresponding to indexing of turret 710 one full position. Home position sensor 766 is mounted to turret frame 711 adjacent side 742 of turret 710 and an opaque tab 767 is mounted to turret 710 so that tab 767 will pass between the arms of sensor 766 when turret 710 is rotated. When sensor 766 senses tab 767, sensor 766 emits a home position signal to the printer controller which sets and determines the absolute position of turret 710 to thereby be able to identify in cooperation with sensor 765 the locations of the cassettes loaded onto to turret 710.

Turret 710 is indexed from one position to the next as follows. Referring to FIG. 10, the printer controller activates motor 732 to rotate crank 734 clockwise one revolution which causes indexing arm 738 to move from the solid line position (#1) through positions #2, #3 and #4 and back to position #1. In position #1, hook 744 is engaged by indexing post 740-1. In moving from position #1 to the broken line position (#2) to the left thereof, hook 744 disengages from post 740-1. Continued clockwise rotation of crank 736 moves indexing arm 78 to broken line position #3 where hook 744 engages the next indexing post 740-2. Continued clockwise rotation of crank 736 moves indexing arm 738 to broken line position #4 which due to engagement of hook 744 with indexing post 740-2 causes turret 710 to rotate clockwise so that indexing post 740-2 is at the position of the hook of the #4 position index arm, which position of indexing post 740-2 is not shown. Finally, clockwise rotation of crank 736 back to the starting solid line position (#1), causes turret 710 to be fully indexed one position so that indexing post 740-2 is at the location in which indexing post 740-1 is shown. Sensor 765 emits a signal after one revolution of pulley 750 which corresponds to one revolution of crank 736, which causes the printer controller to turn off the power to motor 732.

With continued reference to FIG. 10, detent rollers 748 are rotatably mounted in a detent roller frame 775 which is pivotally mounted at one end thereof to turret frame 711 by a pivot joint 777 and guided at the other end thereof by a spring-loaded motion limiting mechanism 779. Motion limiting mechanism 779 comprises a rod 781 slidably located at its lower end relative to turret frame 711 by a stop 782 and pivotally mounted at its upper end to detent roller frame 775 by a pivot 783. Stop 782 comprises a bracket 784 fixed to turret frame 711 and an abutment 786 fixed to the lower end of rod 781. As shown in FIG. 10, abutment 786 may be formed by a nut threaded to rod 781 and a washer held on rod 781 by the nut. A compression spring 785 is slidably mounted on rod 781 engaged at one end by detent roller frame 775 and engaged at the other end by bracket 784 of stop 782.

With continued reference to FIG. 10, detent roller frame 775 is in the position shown in FIG. 10 with both of the detent rollers 748 engaging a detent post 746 when spring 785 is in a slightly compressed state so that detent frame 775 is urged upwardly. The force of compression spring 785 resiliently causes detent rollers 748 to engage and seat a post 746 therebetween and form a detent stop for turret 710. Clockwise rotation of turret 710 pivots detent roller frame 775 downwardly while the downstream detent roller 748 rotates, which allows detent post 746 to ride out of engagement with detent rollers 748. After detent post 746 moves away from detent rollers 748, detent roller frame 775 pivots slightly upwardly from the position shown in FIG. 10 until the motion of rod 781 is stopped by stop 782, i.e., until abutment 786 at the end of rod 781 is engaged by bracket 784. When the next detent post 746 rides over the upstream detent roller, detent roller frame 775 is pivoted away from post 746 against the force of compression spring 785. Continued clockwise rotation of turret 710 causes the next post 746 to be seated and engaged by detent rollers 748 with compression spring 785 slightly compressed as shown in FIG. 10.

Turret 710 may be expanded to accommodate more than four cassettes by increasing the diameter of turret 710, by adding additional pairs of cassette holders 650*a*, indexing posts 740 and detent posts 746 to turret 710, and by appropriately changing the reduction drive system 736 and coupling from motor 732 to indexing arm 738. Moreover, different drive systems for indexing turret 710 may be provided. For example, a Geneva-type drive system may be provided for bi-directionally indexing the turret.

Figure 12:
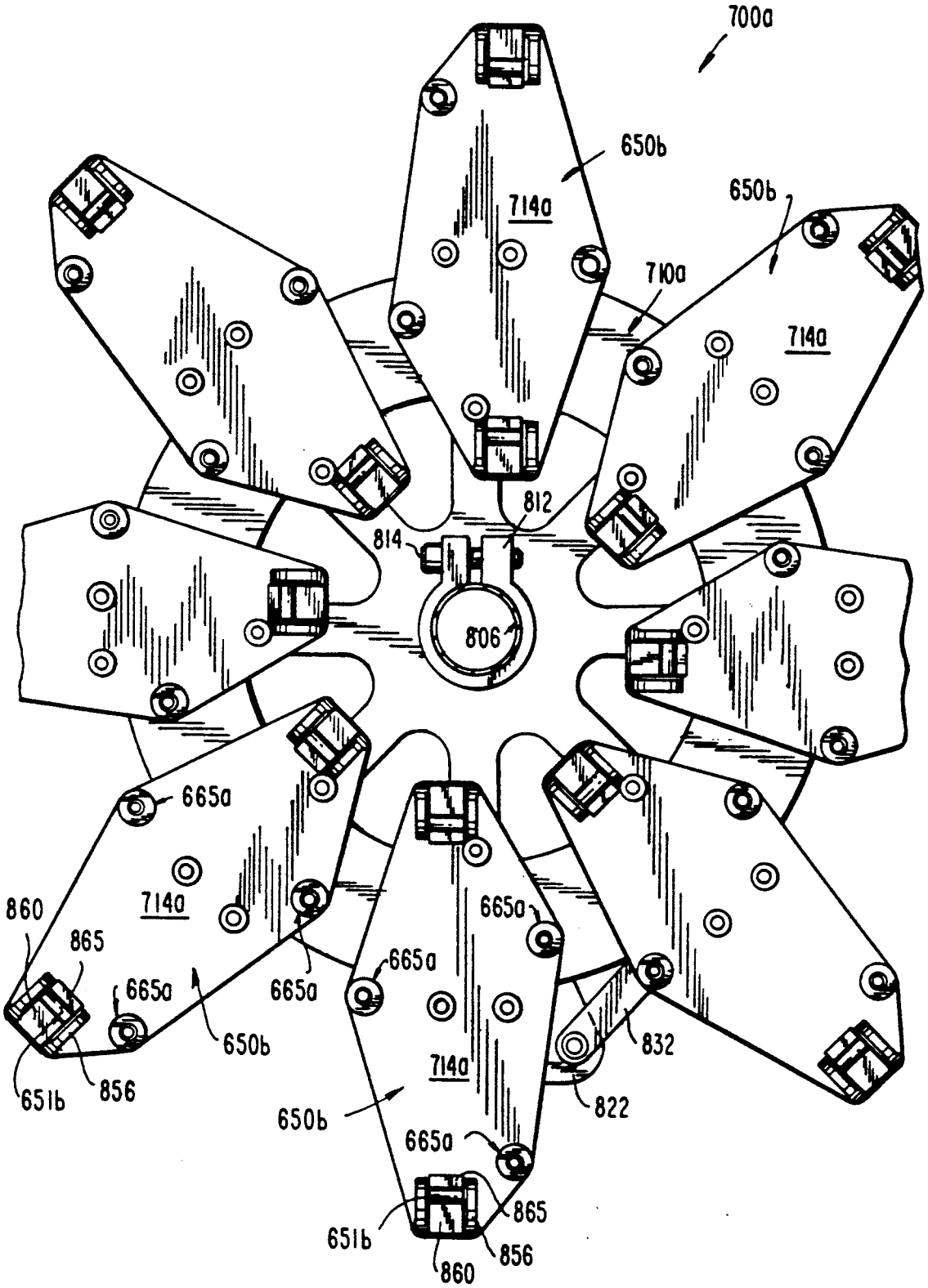
FIG. 12 is an elevation view of the cassette side (left side relative to the thermal printer of FIG. 1) of a turret of the storage portion of the ribbon cassette storage and transfer apparatus according to another embodiment of the invention.
Figure 13:
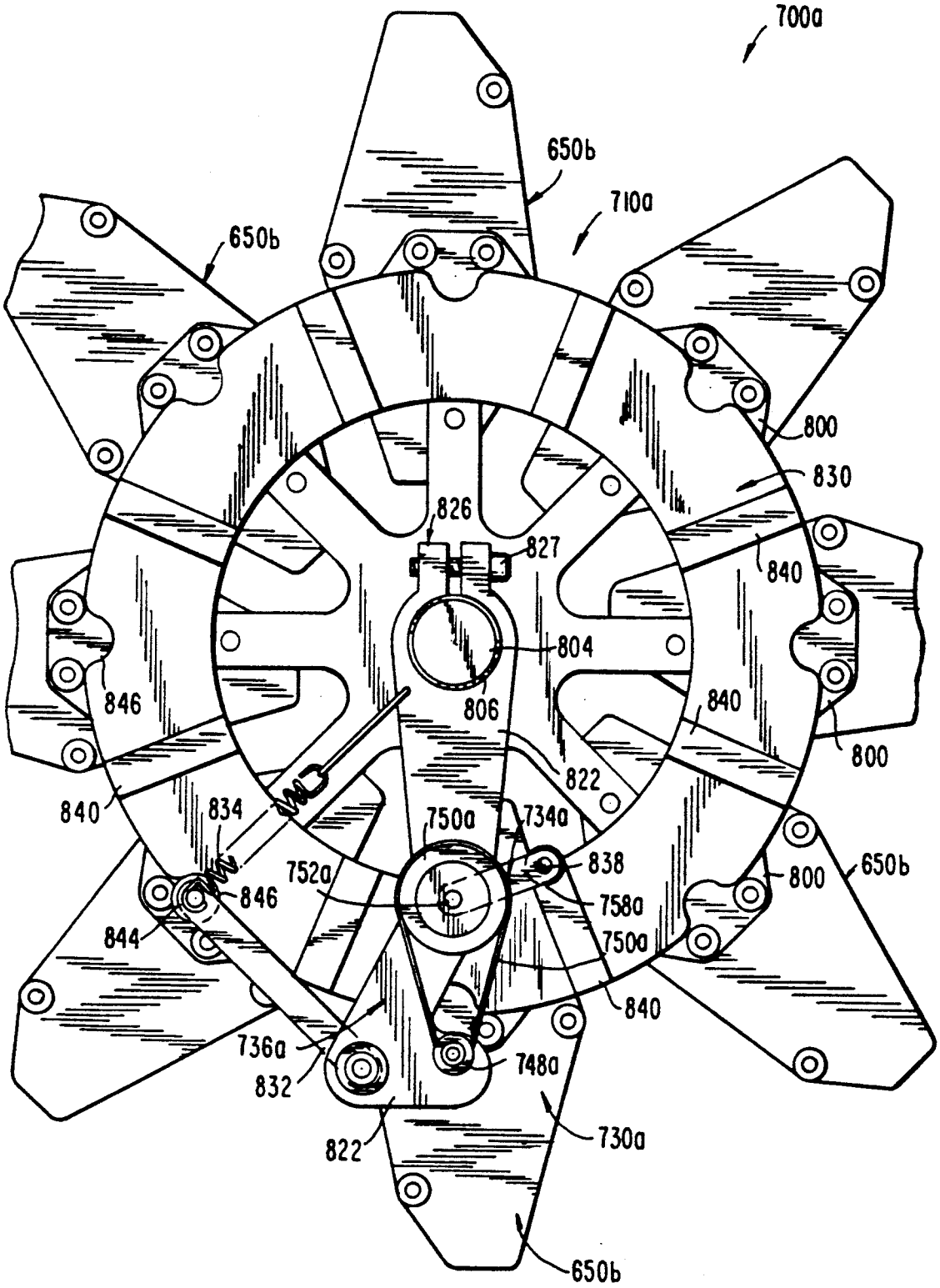
FIG. 13 is an elevation view of the indexing side (right side relative to the thermal printer of FIG. 1) of the turret of FIG. 12.
Figure 14:
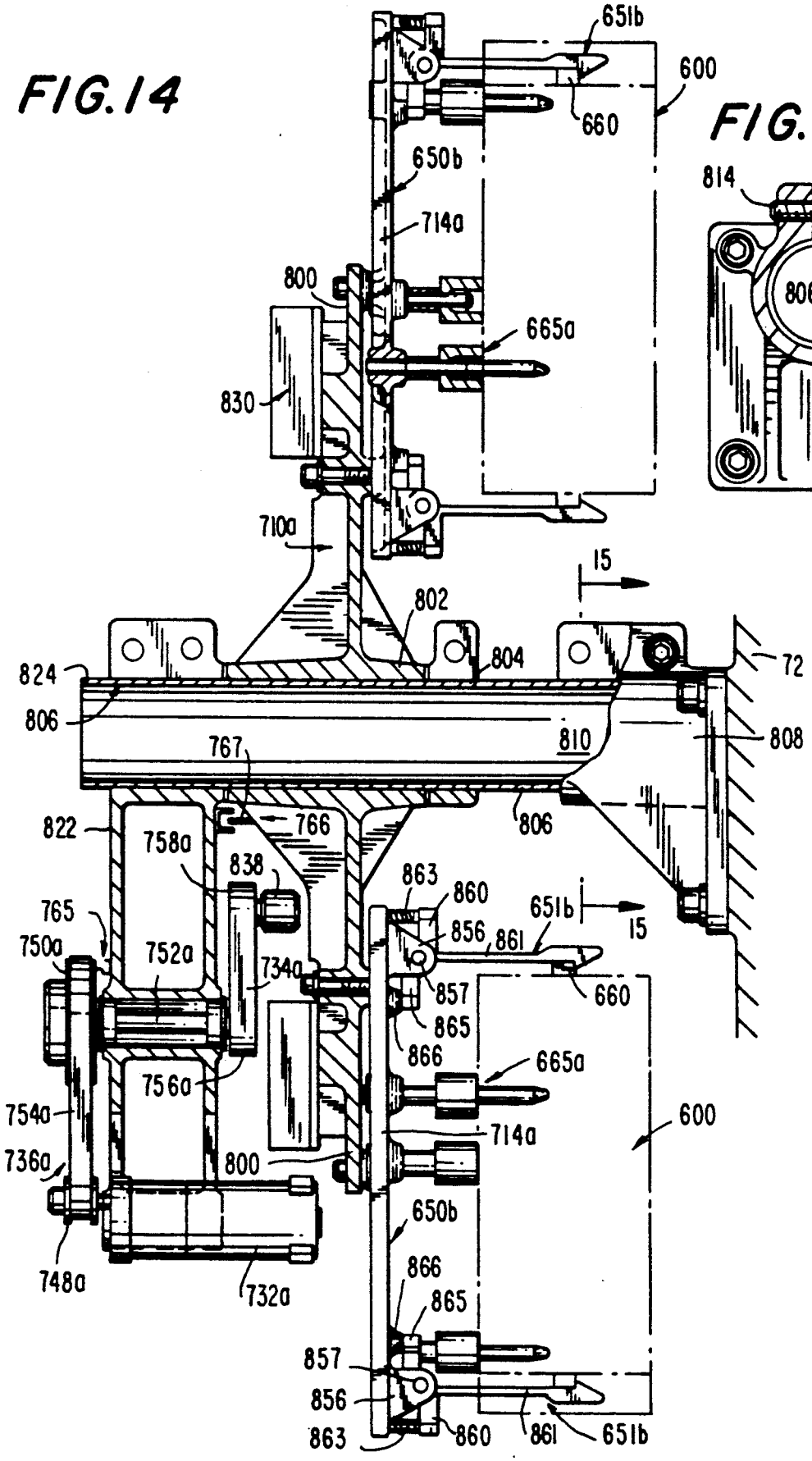
FIG. 14 is a side view, partially in section, of the turret of FIG. 12.
Figure 15:
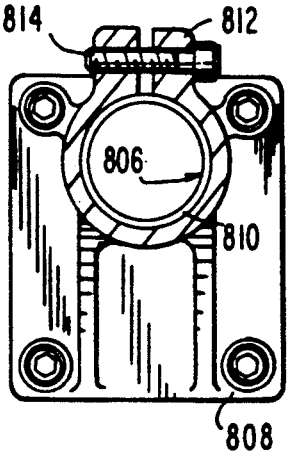
FIG. 15 is a section view taken through line 15—15 of FIG. 14 showing an axle and mounting bracket for mounting the turret of FIG. 12 to the frame of the printer of FIG. 1.

FIGS. 12–14 depict another embodiment of a cassette storage and transfer apparatus 700*a* employing a rotatable turret. The embodiment of apparatus 700*a* depicted in FIGS. 12–14 comprises a turret 710*a* and an indexing system 730*a*. which employs a Geneva-type drive for indexing turret 710*a*. Apparatus 700*a* of FIGS. 12–14 is configured to be mounted on the left side of thermal printer 25, as opposed to the right side where apparatus 700*a* of FIGS. 8–10 is mounted. The side of thermal printer 25 to which the cassette storage and transfer apparatus is mounted is not critical. For left side mounting, the cassette mounting and drive system 601 shown in FIGS. 1 and 4 would be mounted on the left side of carriage 62 with the cassette holders and cassettes facing the print carriage, rather than in the opposite position shown on the right side of printer 25 in FIGS. 1 and 4.

Turret 710*a* (FIG. 13) is a star-shaped wheel having eight arms 800 spaced along the outer periphery thereof to which are attached (as described below) cassette holders 650*b* to define eight turret locations. Star wheel turret 710*a* has a hub 802 (FIG. 14) with a central opening 804, and is supported by a support axle 806 passing through hole 804. Support axle 806 is fixed to Y-axis frame 72 by a bracket 808. The right end 810 of axle 806 is received in a split collar 812 which may be tightened with bolt 814 to clamp axle 806 to collar 812. A bearing rotatably supports hub 802 of turret 710*a* on axle 806.

Referring to FIGS. 13 and 14, indexing system 730*a* for turret 710*a* comprises a Geneva-type drive which includes: drive motor 732*a* and reduction drive system 736*a* supported by a frame 822 clamped to the left end 824 of axle 806 by a split collar 826 and a bolt 827; a crank arm 734*a* which is coupled to motor 732*a* by the reduction drive system 736*a*; a dial or drive plate 830 which is affixed to the left side of turret 710*a*; and a detent arm 832 (FIG. 13) pivotally mounted to frame 822 and urged against the outer periphery of dial plate 830 by a spring 834. Referring to FIGS. 13 and 14, the Geneva-type drive of indexing system 736*a* operates from the inner periphery of dial plate 830, rather than from the outside as in conventional Geneva drives. Also, a conventional Geneva drive typically utilizes in addition to a crank arm which engages a slot in a dial plate, a cam which rotates in engagement with the outer periphery of the dial plate. The Geneva-type drive described below does not include such a cam. The construction and operation of conventional Geneva drives is well known in the art.

Referring to FIG. 13, crank arm 734*a* has a roller 838 connected to the free end 758*a* thereof rotatable about an axis transverse to the longitudinal axis of crank arm 734*a*. Roller 838 is sized to roll in slots 840 spaced along the face of drive plate 830. Referring to FIG. 13, detent arm 832 has a roller 844 connected to the free end thereof rotatable about an axis transverse to the longitudinal axis of detent arm 832. Roller 844 is sized to fit in and releasably engage semi-circular detent notches 846 spaced along the outer periphery of dial plate 830. The spacing of the detent notches 846 from each other equals the spacing of the slots 840 from each other, and corresponds to the spacing between adjacent turret locations of cassettes 600 on turret 710*a*.

With reference to FIG. 14, reduction drive system 736*a* comprises a timing pulley 748*a* fixed to the shaft of motor 732*a*, a timing pulley 750*a* fixed to a shaft 752*a* which is rotatably mounted by bearings to turret frame 822 and a timing belt 754*a* positively connecting pulleys 748*a* and 750*a*. Crank arm 734*a* is connected at one end 756*a* to shaft 752*a* to rotate therewith so that roller 838 connected to the opposite end 758*a* defines a circle as shaft 752*a* rotates. Referring to FIG. 14, sensors 765 and 766 are provided so that the printer controller may set and determine the absolute position of turret 710*a* at power-up and during operation, and may be configured and operate as described above in connection with turret 710 to indicate one complete revolution of pulley 750*a* and the home position of turret 710*a*.

Figure 16A:
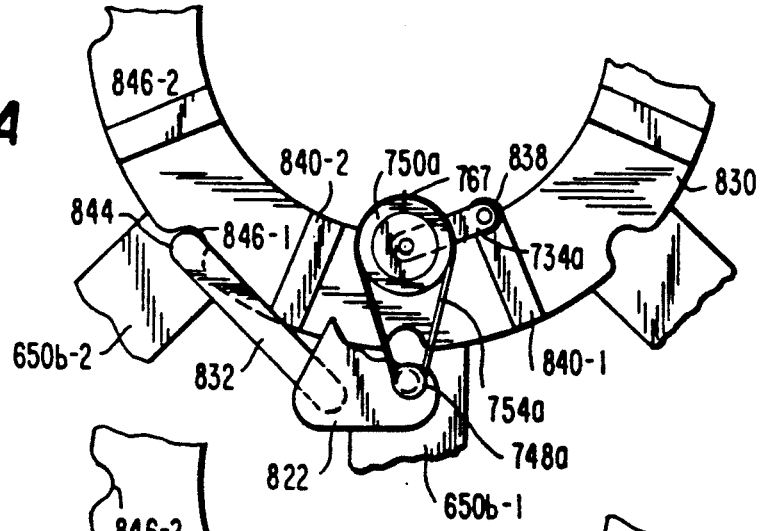
FIGS. 16A–D are schematic diagrams showing the crank arm, roller and dial or drive plate of a Geneva-type drive for indexing the turret of FIG. 12 in a sequence engaging and moving the dial plate of the Geneva-type drive.
Figure 16B:
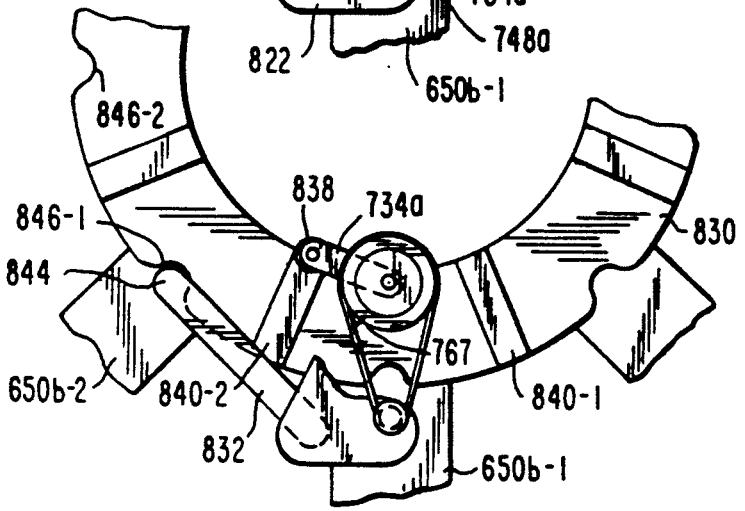
Figure 16C:
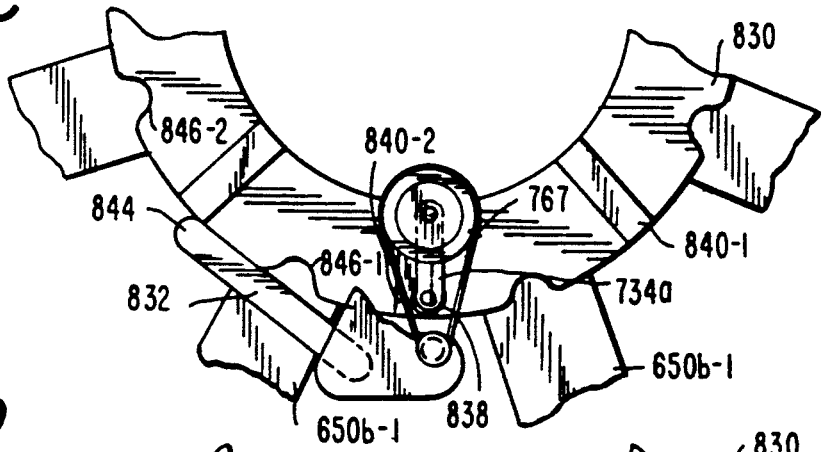
Figure 16D:
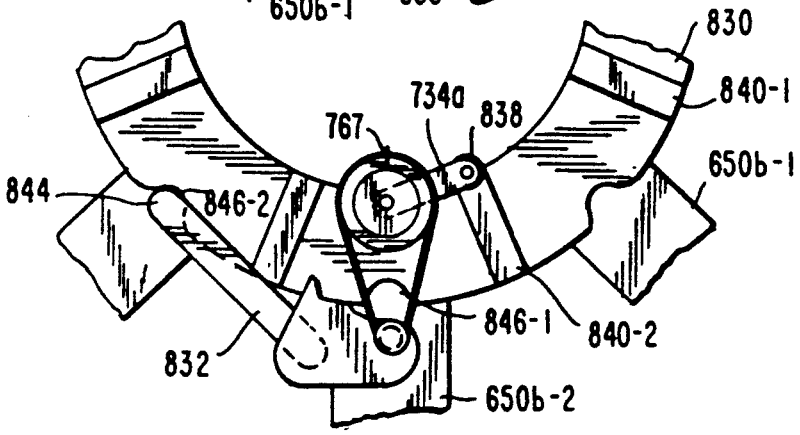

Turret 710*a* is indexed counterclockwise from one position to the next as follows. Referring to FIGS. 16A–D, one revolution of pulley 750*a* rotates crank arm 734*a* 360° according to the following sequence. With dial plate 830 of turret 710*a* positioned with a cassette holder 650*b*-1 in the cassette exchange position shown in FIG. 16A, and a cassette holder 650*b*-2 on the clockwise side of the cassette exchange position, roller 838 is positioned in the inner end of a slot 840-1 on the counterclockwise side of arm 800-1, and detent roller 844 is seated in a detent notch 846-1 on the clockwise side of arm 800-1. Spring 834 urges roller 844 into notch 846-1 to maintain turret 710*a* in the cassette exchange position. Motor 732*a* is activated to rotate crank arm 734*a* counterclockwise into the next slot 840-2 in dial plate 830 as shown in FIG. 16B. At this point, dial plate 830 has not been rotated and the positions of cassette holders 650*b*-1 and 650*b*-2 remain unchanged. The relative positions in FIGS. 16A–D of tab 767 of sensor 766 indicate the angular rotation of pulley 750*a* from figure to figure. As crank arm 734*a* continues to be rotated (FIG. 16C), it engages slot 840-2 and rotates dial plate 830 counterclockwise overcoming the force of spring 834 so that detent roller 844 rolls out of engagement with detent notch 846-1 and rides along the outer periphery of dial plate 830. Rotation of dial plate 830 also causes turret 710*a* and cassette holders 650*b*-1 and 650*b*-2 to rotate. Crank arm 734*a* continues to rotate until sensor 765 sends a signal to the printer controller indicating that pulley 750*a* has completed a complete revolution, at which time motor 732*a* is deactivated, detent roller 844 has entered and become seated in the next detent notch 846-2, and cassette holder 650*b*-2 is in a cassette exchange home position, as shown in FIG. 16D.

As mentioned above, turret 710*a* may be indexed bi-directionally. To index turret 710*a* clockwise, the direction of motor 732*a* is reversed from that which indexes turret 710*a* counterclockwise, and crank arm 734*a* is rotated clockwise to immediately engage and move within slot 840-1 (FIG. 16A) and rotate dial plate 830 clockwise. A complete revolution of pulley 750*a* as sensed by sensor 765 causes turret 710*a* to rest again in a cassette exchange home position.

The structure for releasably mounting cassettes 600 to turret 710*a* is similar to that shown in FIGS. 7 and 8, and operates in a similar manner. Referring to FIG. 14, a cassette 600 is releasably mounted to turret 710*a* by a cassette holder assembly 650*b* which includes spring-loaded, pivoting cassette retention arms 651*b* instead of the flexible retention snaps 651, 651*a* shown in FIGS. 7 and 8, and which also includes spring-loaded guide pin assemblies 665*a*. Each cassette mounting assembly includes a base 714*a* to opposite ends of which retention arms 651*b* are pivotally mounted.

Referring to FIG. 14, each retention arm 651*b* is pivotally mounted at one end thereof to an ear 856 by a pivot joint 857. Retention arm 651*b* at the end thereof pivoted to ear 857 has an extension 860 extending therefrom at a right angle to the main part 861. A compression spring 863 is mounted in engagement with the end of arm extension 860 and the base 714*a* to urge main part 861 of retention arm 651*b* to pivot towards cassette 600 to cause the right angle detent surface 657 of the retention arm to engage the snap lug 660 on the cassette. A stop to limit pivoting of retention arm 651*b* toward cassette 600 comprises another extension 865 extending from retention arm 651*b* in the opposite direction to extension 860, and a projection 866 on base 714*a* extending up to extension 865. With no cassette held between retention arm 650*b*, pivoting of retention arm 651*b* is stopped by engagement of extension 865 with projection 866.

Cassette holder assemblies 650*b* function similar to cassette holders 650 and 650*a* to retain a cassette between arms 651*a*, and also function similar to cassette holders 650 and 650*a* with respect to transfer of a cassette between two holders, except that retention arms 651*b* pivot under spring action rather than flex. Guide pin assemblies 665*a* function as described above in connection with turret 710.

While the invention has been described and illustrated in connection with preferred embodiments, many variations and modifications as will be evident to those skilled in this art may be made without departing from the spirit and scope of the invention. For example, instead of spring loading retention snaps 651 and 651*a* by means of leaf spring action, or resiliently pivoting retention arms 651*b*, these retention snaps and arms, or equivalent devices may be activated by other means, e.g., a solenoid. The invention as set forth in the appended claims is thus not to be limited to the precise details of construction set forth above as such variations and modifications are intended to be included within the scope of the appended claims.

What is claimed is:

1. Apparatus adapted for use with a printer including a movable print head and means for moving the print head along a path of travel, said apparatus removably mounting a ribbon cassette to move with the print head along the path of travel thereof, storing at least one other such cassette at a storage station and transferring a selected cassette between the storage station and for movement with the movable print head, said apparatus comprising;

cassette first holding means mounted to move with the print head for releasably holding a cassette for movement with the print head along the path of travel thereof, said first holding means positioning the cassette relative to the print head such that the ribbon of the cassette may be moved and acted upon by the print head;

at least one cassette second holding means mounted separately from the print head at the storage station so as not to move with the print head along the path of travel thereof, one for each cassette to be held at the storage station; and means for causing a cassette carried by either said first holding means or a selected second holding means to be released by the respective first or second holding means holding the cassette and transferred to the other of the respective first and second holding means.

2. Apparatus adapted for use with a printer including a movable print head and means for moving the print head along a path of travel, said apparatus mounting a ribbon cassette to move with the print head along the path of travel thereof, storing at least one other such cassette at a storage station and transferring a selected cassette between the storage station and for movement with the movable print head, said apparatus comprising;

cassette first holding means mounted to move with the print head for releasably holding a cassette for movement with the print head along the path of travel thereof, said first holding means positioning the cassette relative to the print head such that the ribbon of the cassette may be moved and acted upon by the print head;

at least one cassette second holding means mounted separately from the print head at the storage station so as not to move with the print head along the path of travel thereof, one for each cassette to be held at the storage station;

means for positioning any selected cassette second holding means mounted at the storage station in or adjacent the path of travel of the print head; and means for causing a cassette carried by either said first holding means or a second holding means positioned adjacent the path of travel of the print head to be released by the respective first or second holding means holding the cassette and transferred to the other of the respective first and second holding means.

3. Apparatus adapted for use with a printer including a movable carriage, means for moving the carriage along a path of travel, and a print head mounted to the carriage for movement therewith along the path of travel thereof, said apparatus mounting a ribbon cassette on the carriage to move with the print head along the path of travel of the carriage, storing at least one other such cassette at a storage station off the carriage and transferring a selected cassette between the storage station and the movable carriage, said apparatus comprising;

cassette first holding means mounted on the movable carriage for releasably holding a cassette for movement with the print head along the path of travel of the carriage, said first holding means positioning the cassette relative to the print head such that the ribbon of the cassette may be moved and acted upon by the print head;

at least one cassette second holding means mounted off the carriage at the storage station, one for each cassette to be held at the storage station;

means for positioning any selected cassette second holding means mounted at the storage station in or adjacent the path of travel of the carriage; and means for causing a cassette carried by either said first holding means or a second holding means positioned adjacent the path of travel of the print head to be released by the respective first or second holding means holding the cassette and transferred to the other of the respective first and second holding means.

4. Apparatus adapted for use with a printer including a movable carriage, means for moving the carriage along a path of travel and a print head mounted to the carriage for movement therewith along the path of travel thereof, said apparatus storing a plurality of ribbon cassettes at a storage station and transferring a selected cassette between the storage station off the carriage and the movable carriage of the printer, said apparatus comprising;

cassette first holding means mounted to the carriage for releasably holding a cassette for movement with the carriage along the path of travel thereof, said first holding means positioning the cassette relative to the print head such that the ribbon of the cassette may be moved and acted upon by the print head;

a plurality of cassette second holding means mounted off the carriage at the storage station, one for each of the plurality of cassettes to be held at the storage station;

the storage station being positioned in or adjacent the path of travel of the carriage; and means for positioning any selected cassette second holding means mounted at the storage station in or adjacent the path of travel of the carriage in alignment with said cassette first holding means mounted to the carriage;

said cassette first holding means and each of said cassette second holding means comprising structure which engage each other when a second holding means is positioned in the path of travel of the carriage aligned with said first holding means and the carriage is moved to the storage station, and which disengage each other when the carriage is moved away from the storage station, the engaging structure of said first holding means and the engaging structure of said second holding means which is positioned in the path of travel of the carriage when becoming engaged with each other causing a cassette held by one of those holding means automatically to be transferred to the other of those holding means.

5. In a printer comprising a movable carriage, means for moving the carriage along a path of travel relative to a medium on which the printer is to print, and a print head mounted to the carriage for movement therewith along the path of travel thereof; apparatus for storing a plurality of ribbon cassettes at a storage station and for transferring a selected cassette between the storage station and the movable carriage, said apparatus comprising:

cassette first holding means mounted to the carriage for releasably holding a cassette for movement with the carriage along the path of travel thereof, said first holding means positioning the cassette relative to the print head such that the ribbon of the cassette may be moved and acted upon by the print head;

a plurality of cassette second holding means mounted at the storage station, one for each of the plurality of cassettes to be held at the storage station;

the storage station being positioned in or adjacent the path of travel of the carriage; and means for positioning any selected cassette second holding means mounted at the storage station in or adjacent the path of travel of the carriage in alignment with said cassette first holding means mounted to the carriage;

said cassette first holding means and each of said cassette second holding means comprising structure which engage each other when a second holding means is positioned in the path of travel of the carriage aligned with said first holding means and the carriage is moved to the storage station, and which disengage each other when the carriage is moved away from the storage station, the engaging structure of said first holding means and the engaging structure of the second holding means which is positioned in the path of travel of the carriage when becoming engaged with each other causing a cassette held by one of those holding means automatically to be transferred to the other of those holding means.

6. A printer comprising a movable carriage, means for moving the carriage along a path of travel relative to a medium on which the printer is to print, a print head mounted to the carriage for movement therewith along the path of travel thereof, and apparatus for storing a plurality of ribbon cassettes at a storage station and for transferring a selected cassette between the storage station and said movable carriage, said apparatus comprising:

cassette first holding means mounted to said carriage for releasably holding a cassette for movement with said carriage along the path of travel thereof, said first holding means positioning the cassette relative to said print head such that the ribbon of the cassette may be moved and acted upon by said print head;

a plurality of cassette second holding means mounted at the storage station, one for each of the plurality of cassettes to be held at the storage station;

the storage station being positioned in or adjacent the path of travel of said carriage; and means for positioning any selected cassette second holding means mounted at the storage station in or adjacent the path of travel of said carriage in alignment with said cassette first holding means mounted to said carriage;

said cassette first holding means and each of said cassette second holding means comprising structure which engage each other when a second holding means is positioned in the path of travel of said carriage aligned with said first holding means and said carriage is moved to the storage station, and which disengage each other when said carriage is moved away from the storage station, the engaging structure of said first holding means and the engaging structure of the second holding means which is positioned in the path of travel of said carriage when becoming engaged with each other automatically causing a cassette held by one of those holding means to be transferred to the other of those holding means.

7. The apparatus of claim 4, 5 or 6 wherein said engaging structure of said first holding means and said engaging structure of said second holding means are identical.

8. The apparatus of claim 4, 5 or 6 wherein said means for positioning a selected second holding means comprises means for connecting each of said plurality of second holding means together at the storage station for movement together relative to the path of travel of the carriage and means for moving said connecting means to position a selected second holding means in the path of travel of the carriage in alignment with said first holding means mounted to the carriage.

9. The apparatus of claim 8 wherein said connecting means connects said plurality of second holding means extending in a circle, and wherein said means for moving rotates said connecting means coaxially with the axis of the circle.

10. The apparatus of claim 9 wherein said connecting means comprises a disc-, ring- or wheel-like member having an axis coaxial with the axis of the circle, said member being located at an end of the path of travel of the carriage.

11. The apparatus of claim 8 wherein said connecting means connects each of said plurality of second holding means extending linearly adjacent each other along a longitudinal axis, and wherein said means for moving moves said connecting means relative to the path of travel of the carriage to position a selected second holding means in alignment with said first holding means mounted to the carriage.

12. The apparatus of claim 11 wherein said moving means linearly moves said connecting means parallel to the longitudinal axis.

13. The apparatus of claim 11 wherein said moving means pivots said connecting means about the longitudinal axis.

14. The apparatus of claim 8 wherein said connecting means connects each of said plurality of second holding means extending in an endless loop, and wherein said means for moving moves said connecting means in the loop.

15. The apparatus of claim 14 wherein said connecting means comprises a belt-like structure.

16. The apparatus of claim 15 wherein said belt-like structure is located at an end of the path of travel of the operating station.

17. The apparatus of claim 4, 5 or 6 wherein said positioning means connects each of said plurality of second holding means in a group and for individual movement relative to each other, and wherein said moving means moves a selected second holding means into alignment with said first holding means mounted to the carriage.

18. The apparatus of claim 17 wherein said second holding means are connected linearly extending along a longitudinal axis for individual pivoting movement about said axis.

19. The apparatus of claim 8 wherein said storage station is located at an end of the path of travel of the carriage.

* * * * *